US010488807B2

(12) United States Patent
Iriyama et al.

(10) Patent No.: US 10,488,807 B2
(45) Date of Patent: Nov. 26, 2019

(54) CHARGE REMOVAL PROCESS IN IMAGE FORMING APPARATUS

(71) Applicant: Brother Kogyo Kabushiki Kaisha, Nagoya-shi, Aichi-ken (JP)

(72) Inventors: Shota Iriyama, Nagoya (JP); Kazutoshi Kotama, Nagoya (JP); Chieko Mimura, Nagoya (JP); Kengo Yada, Nagoya (JP); Hotaka Kakutani, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/901,357

(22) Filed: Feb. 21, 2018

(65) Prior Publication Data

US 2018/0246462 A1 Aug. 30, 2018

(30) Foreign Application Priority Data

Feb. 24, 2017 (JP) ..... 2017-033699

(51) Int. Cl.
*G03G 21/06* (2006.01)
*G03G 15/00* (2006.01)
(Continued)

(52) U.S. Cl.
CPC ..... *G03G 21/06* (2013.01); *G03G 15/0266* (2013.01); *G03G 15/50* (2013.01); *G03G 21/0094* (2013.01); *G03G 2215/02* (2013.01)

(58) Field of Classification Search
CPC .... G03G 21/06; G03G 15/0266; G03G 15/50; G03G 2215/02; G03G 21/08; G03G 2215/021; G03G 21/0094
See application file for complete search history.

(56) References Cited

U.S. PATENT DOCUMENTS 6,898,393 B2 * 5/2005 Kawamura ..... G03G 15/0225 399/100
2009/0022517 A1 1/2009 Kanai et al.
(Continued)

FOREIGN PATENT DOCUMENTS

JP 2002162876 A 6/2002
JP 200942738 A 2/2009
JP 2016142856 A 8/2016

*Primary Examiner* — David M. Gray
*Assistant Examiner* — Laura Roth
(74) *Attorney, Agent, or Firm* — Banner & Witcoff, Ltd.

(57) ABSTRACT

An image forming apparatus executes charging, exposure, toner-supply suspension, and electric-field generation while a photosensitive member rotates at least a full turn. In the charging, a charger charges a portion of a circumferential surface of the photosensitive member. In the exposure, an exposure device exposes the portion, which has been charged in the charging, of the circumferential surface. In the toner-supply suspension, before the portion, which has been exposed in the exposure, of the circumferential surface passes a position at which developer from a developing unit is configured to initially adhere to the circumferential surface, a developing unit stops supplying developer to the photosensitive member. In the electric-field generation, an electric field is generated in a portion of the photosensitive layer of the photosensitive member corresponding to the portion, which has been exposed by the exposure device, of the circumferential surface.

17 Claims, 17 Drawing Sheets

(51) Int. Cl.
*G03G 15/02* (2006.01)
*G03G 21/00* (2006.01)

(56) References Cited

U.S. PATENT DOCUMENTS

2014/0016953 A1* 1/2014 Yoshida ..... G03G 15/55
399/26
2016/0147168 A1* 5/2016 Ofir ..... G03G 15/0275
399/128

* cited by examiner

SECOND CHARGING

SECOND EXPOSURE

SECOND EXPOSURE

SECOND-ELECTRIC-FIELD GENERATION

SECOND-ELECTRIC-FIELD GENERATION

CHARGE VOLTAGE
V1
0
EXPOSURE
ON
OFF
TRANSFER VOLTAGE
-V2
0
DEVELOPING ROLLER
CONTACTED
SEPARATED
TD
T1
T2
T3
T4
T5
TF
t1
t2
t3
t4
t5
t6
t7
t8
t9
t10
t11
t12
t13
t14
t15
t16

CHARGE REMOVAL PROCESS IN IMAGE FORMING APPARATUS

CROSS-REFERENCE TO RELATED APPLICATION

This application claims priority from Japanese Patent Application No. 2017-033699 filed on Feb. 24, 2017, the content of which is incorporated herein by reference in its entirety.

TECHNICAL FIELD

Aspects disclosed herein relate to an image forming apparatus including a photosensitive member, a method of controlling the image forming apparatus, and a non-transitory computer-readable storage medium storing a program.

BACKGROUND

In known electrophotographic image forming apparatuses, for example, slide contact of a cleaning member or a charge roller relative to a circumferential surface of a photosensitive member causes generation of charges in the photosensitive member, and the generated charges tend to stay and accumulate in the photosensitive member, which may further cause chargeability degradation and/or ghost printing. In order to solve such problems, in one known technique, when power of an image forming apparatus is turned on, charges accumulated in a photosensitive member are removed through exposure of the photosensitive member to a greater exposure than that applied to the photosensitive member in image formation. In another known technique, during an interval between image formation events, charges accumulated in a photosensitive member are removed through charging of a circumferential surface of the photosensitive member while the photosensitive member rotates one or more full (e.g., 360 degrees) turns. In the meantime, a developing roller is kept separated from the photosensitive member, a transfer bias application is stopped, and a static eliminator is caused to be inactivated.

SUMMARY

According to one or more aspects described herein, an image forming apparatus is provided. The image forming apparatus may include an image forming unit, an electric circuit electrically connected to the image forming unit, and a controller electrically connected to the image forming unit. The image forming unit may include a photosensitive member, a charger, an exposure device, and a developing unit. The photosensitive member may have a photosensitive layer. The charger may be configured to charge a circumferential surface of the photosensitive member to generate a first electric field in the photosensitive layer. The exposure device may comprise a light source. The exposure device may be configured to expose the circumferential surface of the photosensitive member. The developing unit may be configured to supply developer onto the circumferential surface of the photosensitive member. The electric circuit may be configured to apply a voltage to generate, in conjunction with an electric field generating member, a second electric field in the photosensitive layer. The second electric field is directed in a direction opposite to the first electric field. The image forming unit may be configured to perform a printing process in which an image is formed on a recording medium. The printing process may include a first charging, a first exposure, and a toner supplying in which toner is supplied from the developing unit to the photosensitive member. The controller may be configured to perform second charging in a period different from an execution period of the first charging and while the photosensitive member rotates at least a full turn. The second charging may include controlling the charger to charge a portion of the circumferential surface of the photosensitive member, thereby generating the first electric field in a corresponding portion of the photosensitive layer. The controller may be configured to perform second exposure while the photosensitive member rotates at least a full turn. The second exposure may include controlling the exposure device to expose the portion, which has been charged in the second charging, of the circumferential surface of the photosensitive member. The controller may be configured to perform toner-supply suspension before the portion, which has been exposed in the second exposure, of the circumferential surface of the photosensitive member passes a position at which developer from the developing unit is configured to initially adhere to the circumferential surface of the photosensitive member. The toner-supply suspension may include controlling the developing unit to stop supplying the developer to the circumferential surface of the photosensitive member. The controller may be configured to perform second-electric-field generation while the photosensitive member rotates at least a full turn. The second-electric-field generation may include controlling the electric circuit to apply the voltage to generate the second electric field in the corresponding portion of the photosensitive layer when the portion, which has been charged in the second charging and subsequently exposed in the second exposure, of the circumferential surface of the photosensitive member reaches a position facing the electric field generating member.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

[First Illustrative Embodiment]

A first illustrative embodiment will be described with reference to appropriate accompanying drawings. In the description below, an overall configuration of a color printer 1 (as an example of an image forming apparatus) will be described, and various features will be then described in detail. The color printer 1 may be a color laser printer.

Figure 1:
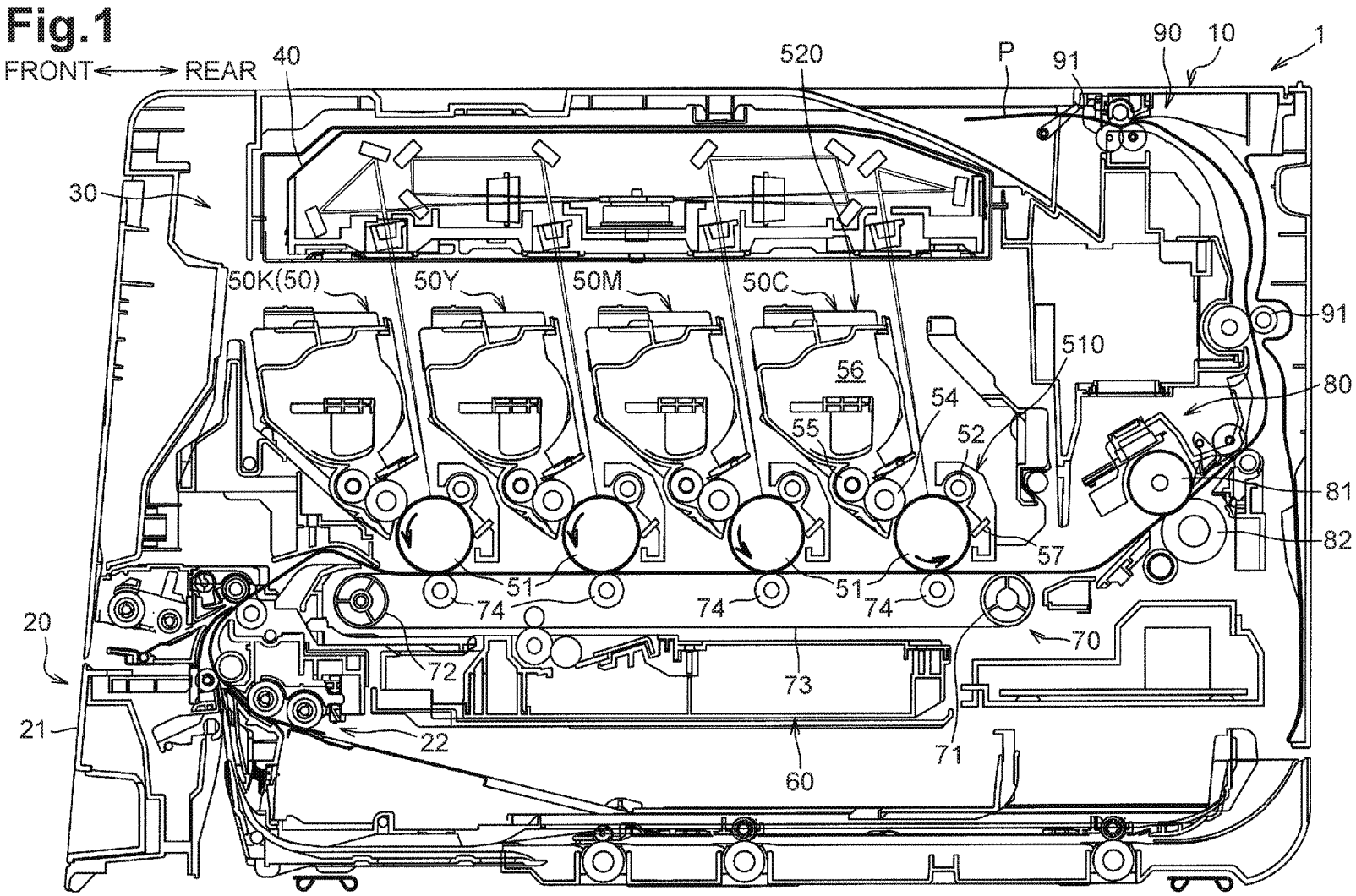
FIG. 1 is a sectional view illustrating a color printer in a first illustrative embodiment according to one or more aspects of the disclosure.

In the description below, as illustrated in FIG. 1, the right and left of FIG. 1 are defined as the rear and front, respectively, of the color printer 1. The right and left of the color printer 1 are defined as viewed from the front of the color printer 1. A top-bottom direction is defined with reference to an orientation of the color printer 1 in which it may be intended to be used.

As illustrated in FIG. 1, the color printer 1 includes a housing 10, a feed unit 20, an image forming unit 30, and a discharge unit 90 in housing 10. The feed unit 20 is configured to feed one or more sheets P (an example of a transfer-receiving medium). The image forming unit 30 is configured to form an image onto a fed sheet P. The discharge unit 90 is configured to discharge a sheet P having an image to the outside of the housing 10.

The feed unit 20 includes a feed tray 21 and a sheet conveyor 22. The feed tray 21 is configured to support one or more sheets P. The sheet conveyor 22 is configured to convey sheets P one by one from the feed tray 21.

The image forming unit 30 includes a scanner 40 (an example of an exposure device), a plurality of process units 50, a transfer unit 70, a cleaning unit 60, and a fixing unit 80.

The scanner 40 is disposed above the plurality of process units 50, and includes laser sources (not illustrated), a polygon mirror, lenses, and reflectors. In the scanner 40, a laser beam is emitted from each of the laser sources. The emitted laser beam travels to a circumferential surface of a corresponding photosensitive drum 51 (as an example of a photosensitive member) while being reflected off the polygon mirror and one or more of the reflectors and passing through the lenses. Thus, the laser beam scans the circumferential surface of the corresponding photosensitive drum 51 at a high scanning speed.

The process units 50 are disposed in tandem in the front-rear direction. Each of the process units 50 includes a drum unit 510 and a developing unit 520. The developing unit 520 is attachable to and detachable from the drum unit 510.

The drum unit 510 includes a photosensitive drum 51, a charge roller 52 (as an example of a charger), and a cleaning blade 57. The developing unit 520 includes a developing roller 54, a supply roller 55, and a toner chamber 56. The toner chamber 56 is configured to store toner (an example of developer).

The process units 50 includes process units 50K, 50Y, 50M, and 50C which store toner of respective colors, e.g., black (K), yellow (Y), magenta (M), and cyan (C), respectively. In one example, the process units 50K, 50Y, 50M, and 50C are disposed in tandem in this order from upstream in a direction in which a sheet P is conveyed. In the description below and the accompanying drawings, when the same or similar components (e.g., the photosensitive drums 51 and the developing rollers 54) are distinguished by toner color, specific letters K, Y, M, and C representing respective toner colors are appended to their reference numerals. Otherwise, the specific letters Y M, C, and K are omitted. In the description below, a plurality of the same components have the same or similar configuration and function in the same or similar manner to each other. Therefore, one of the plurality of same components may be described in detail, and description for the others may be omitted.

Figure 3:
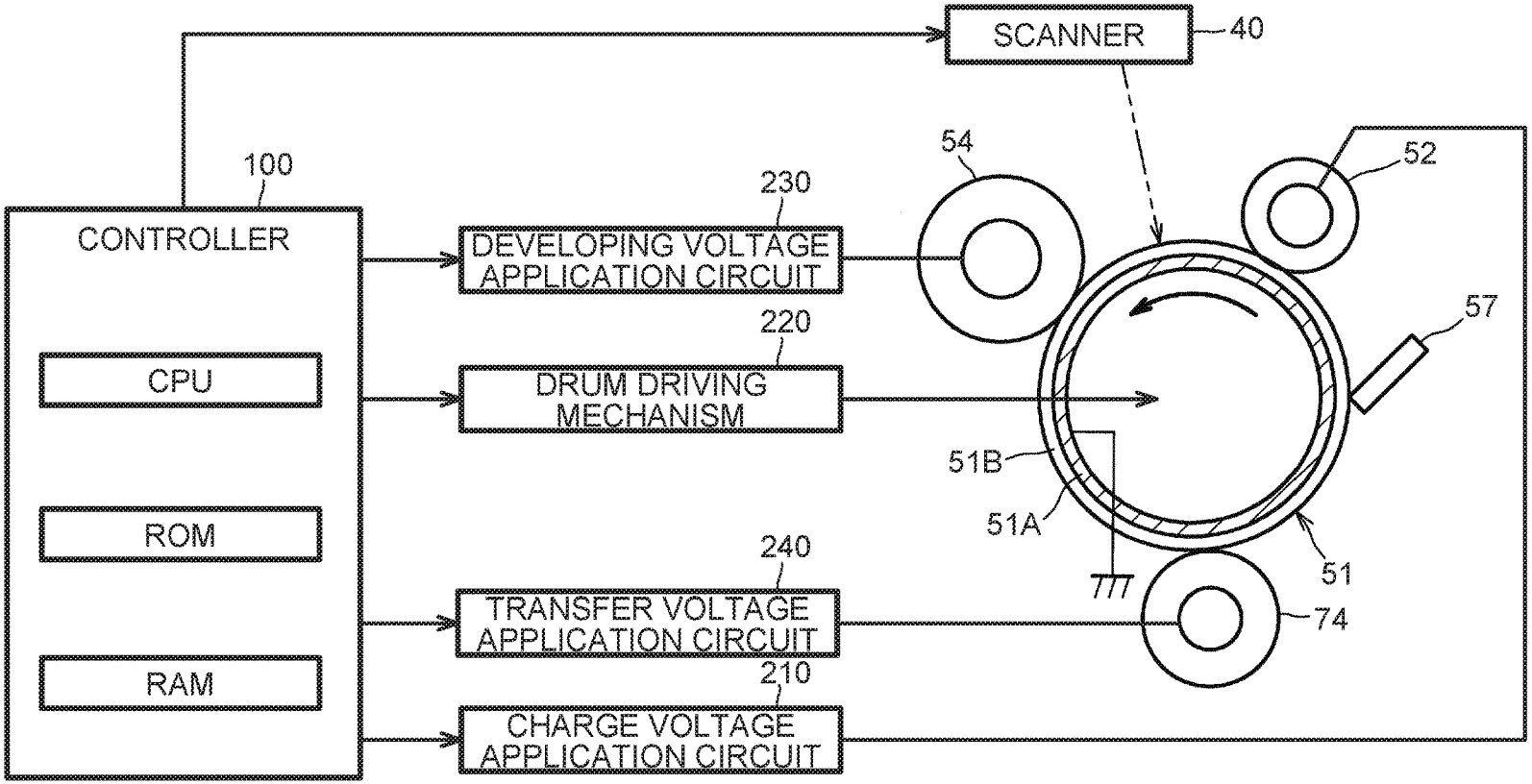
FIG. 3 illustrates an internal configuration of the color printer in the first illustrative embodiment according to one or more aspects of the disclosure.

As illustrated in FIG. 3, the photosensitive drum 51 includes a cylindrical base 51A, and a photosensitive layer 51B formed on an outer circumferential surface of the cylindrical base 51A. The cylindrical base 51A may be made of a conductive member such as metal. The photosensitive layer 51B may be a positively-chargeable organic photosensitive layer containing a charge generating material, an electron transport material, a hole transport material, and a binder resin. The cylindrical base 51A is connected to a ground potential portion of the color printer 1.

The charge roller 52 is configured to charge the circumferential surface of the photosensitive drum 51. The charge roller 52 is in contact with the circumferential surface of the photosensitive drum 51. The charge roller 52 is configured to be applied with a positive charge voltage in charging.

The developing roller 54 may contact the circumferential surface of the photosensitive drum 51 to supply toner onto an electrostatic latent image formed on the circumferential surface of the photosensitive drum 51 to develop the electrostatic latent image with toner. In the illustrative embodiment, when the developing roller 54 supplies toner onto the circumferential surface of the photosensitive drum 51, toner is positively charged by friction caused by sliding of the developing roller 54 and the supply roller 55 relative to each other.

Figure 2:
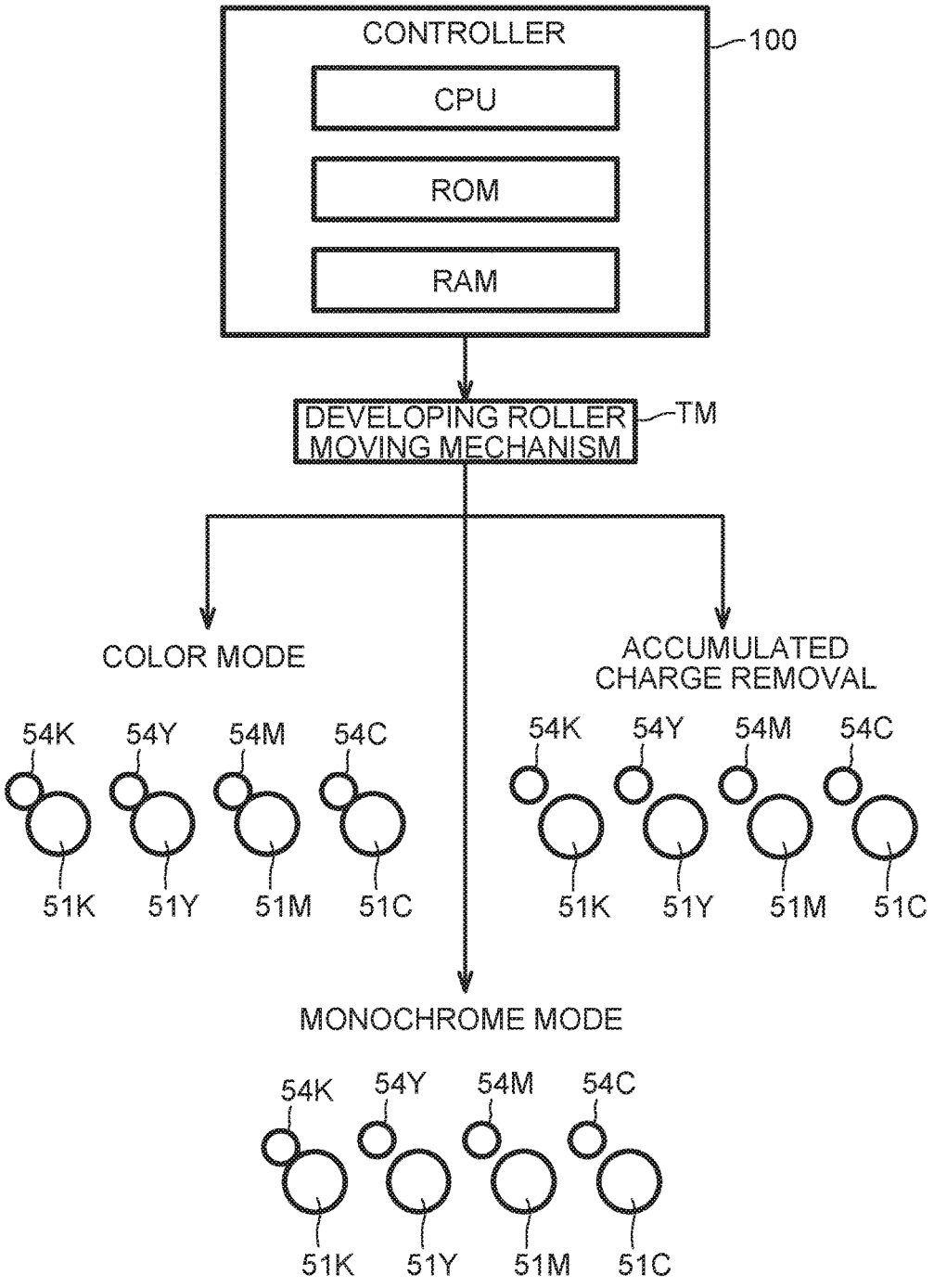
FIG. 2 is a diagram for explaining a contacting and separating manner of developing rollers relative to corresponding photosensitive drums in the first illustrative embodiment according to one or more aspects of the disclosure.

The color printer 1 further includes a developing roller moving mechanism TM. As illustrated in FIG. 2, the developing rollers 54 are configured to contact and separate from the respective photosensitive drums 51 by the developing roller moving mechanism TM that is controlled by a controller 100 of the color printer 1. The developing roller moving mechanism TM is electrically connected to the controller 100. More specifically, for example, in a color mode, all of the developing rollers 54K, 54Y, 54M, and 54C contact the photosensitive drums 51K, 51Y, 51M, and 51C, respectively, to supply toner of respective colors to the corresponding photosensitive drums 51K, 51Y, 51M, and 51C. In a monochrome mode, while the black developing roller 54K contacts the photosensitive drum 51K, the other developing rollers 54Y, 54M, and 54C are kept separated from the photosensitive drums 51Y, 51M, and 51C, respectively. In accumulated charge removal, all of the developing rollers 54K, 54Y, 54M, and 54C are kept separated from the photosensitive drums 51K, 51Y, 51M, and 51C, respectively.

The cleaning blade 57 is configured to collect foreign matters, e.g., toner, adhering to the photosensitive drum 51. As illustrated in FIG. 1, the cleaning blade 57 is in contact with the circumferential surface of the photosensitive drum 51.

The transfer unit 70 is disposed between the feed unit 20 and the plurality of process units 50 in the top-bottom direction. The transfer unit 70 includes a drive roller 71, a driven roller 72, a conveying belt 73, and transfer rollers 74 (each of which is an example of an electric field generating member and an example of a transfer member).

The drive roller 71 and the driven roller 72 extend parallel to each other while being spaced apart from each other in the front-rear direction. The conveying belt 73, e.g., an endless belt, is looped around the drive roller 71 and the driven roller 72. The conveying belt 73 has an outer circumferential surface, which is in contact with the circumferential surfaces of the photosensitive drums 51. The transfer rollers 74 (e.g., four transfer rollers 74) are disposed inside a loop of the conveying belt 73 while being opposite to the respective photosensitive drums 51 relative to the conveying belt 73. Each photosensitive drum 51/transfer roller 74 pair sandwiches the conveying belt 73 therebetween. Each of the transfer rollers 74 is configured to be applied with a negative charge voltage in transferring.

As illustrated in FIG. 1, in each of the process units 50, the charge roller 52, the developing roller 54, the transfer roller 74, and the cleaning blade 57 are disposed around the photosensitive drum 51 in this order with respect to a rotating direction (e.g., counterclockwise in FIG. 1) of the photosensitive drum 51.

The cleaning unit 60 is disposed below the conveying belt 73. The cleaning unit 60 is configured to collect toner adhering to the conveying belt 73 by sliding of the cleaning unit 60 and the conveying belt 73 relative to each other.

The fixing unit 80 is disposed further to the rear than the plurality of process units 50 and the transfer unit 70. The fixing unit 80 includes a heat roller 81 and a pressure roller 82. The pressure roller 82 faces the heat roller 81 and presses the heat roller 81.

For color printing, in the image forming unit 30, the circumferential surface of each of the photosensitive drums 51 is uniformly and positively charged by each corresponding charge roller 52 and is then exposed to a laser beam emitted by the scanner 40. As a result of the exposure, in each of the photosensitive drums 51, both positive and negative charges are generated inside the photosensitive layer 51B (refer to FIG. 3) and the negative charge is transported toward an outer surface of the photosensitive layer 51B. Thus, some of the positive charge accumulated on the outer surface of the photosensitive layer 51B in charging is cancelled out by some negative charge transported to the outer surface of the photosensitive layer 51B and therefore an electrostatic latent image is formed on each of the photosensitive drums 51. Thereafter, each of the developing rollers 54 supplies toner onto the circumferential surface of each of the corresponding photosensitive drums 51 from the developing unit 520 to form a toner image on the circumferential surface of each of the photosensitive drums 51.

When a sheet P placed on the conveyor belt 72 passes between each photosensitive drum 51/transfer roller 74 pair, the toner image formed on each of the photosensitive drums 51 is transferred onto the sheet P. For monochrome printing, in the image forming unit 30, the same or similar operation is performed on the components to be involved in printing in black K. Thereafter, when the sheet P passes between the heat roller 81 and the pressure roller 82, the toner images transferred on the sheet P are thermally fixed thereon.

The discharge unit 90 includes a plurality of conveying rollers 91 for conveying a sheet P. The conveying rollers 91 convey a sheet P, on which a toner image has been transferred and thermally fixed, and discharge the sheet P to the outside of the housing 10.

As illustrated in FIG. 3, the color printer 1 further includes a charge voltage application circuit 210, a drum driving mechanism 220, a developing voltage application circuit 230, and a transfer voltage application circuit 240, as well as the controller 100. The charge voltage application circuit 210, the drum driving mechanism 220, the developing voltage application circuit 230, and the transfer voltage application circuit 240 are each electrically connected to controller 100.

The charge voltage application circuit 210 is configured to apply a positive charge voltage to each of the charge rollers 52. The charge voltage application circuit 210 is electrically connected to each of the charge rollers 52. The drum driving mechanism 220 is configured to rotate the photosensitive drums 51, and includes, for example, a motor, gears, and a clutch. The drum driving mechanism 220 is electrically connected to each of the photosensitive drums 51.

The developing voltage application circuit 230 is configured to apply a positive developing bias to each of the developing rollers 54. The developing voltage application circuit 230 is electrically connected to each of the developing rollers 54. Developing bias to be applied during printing is lower than the charge voltage and higher than a surface potential of an exposed portion of the photosensitive drum 51. The transfer voltage application circuit 240 is configured to apply a negative transfer voltage to each of the transfer rollers 74. The transfer voltage application circuit 240 is electrically connected to each of the transfer rollers 74.

The controller 100 includes, for example, a CPU, a ROM, and a RAM. The controller 100 is configured to, in response to receipt of a print instruction, output a control signal to each of the image forming unit 30 and the discharge unit 90 in accordance with predetermined programs. The controller 100 is configured to execute image formation for forming a toner image onto a sheet P, and accumulated charge removal for removing accumulated charges from the inside of the photosensitive layer 51B of each of the photosensitive drums 51. The controller 100 is configured to, when executing the image formation or the accumulated charge removal, control the drum driving mechanism 220 to rotate the photosensitive drums 51.

Figure 5A:
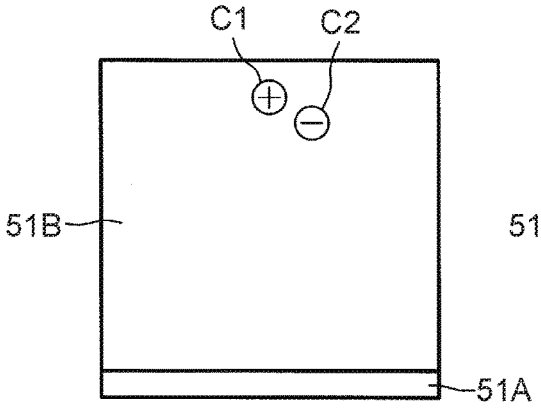
FIGS. 5A and 5B show principles of how charges are generated and accumulated inside a photosensitive layer in the first illustrative embodiment according to one or more aspects of the disclosure.
Figure 5B:
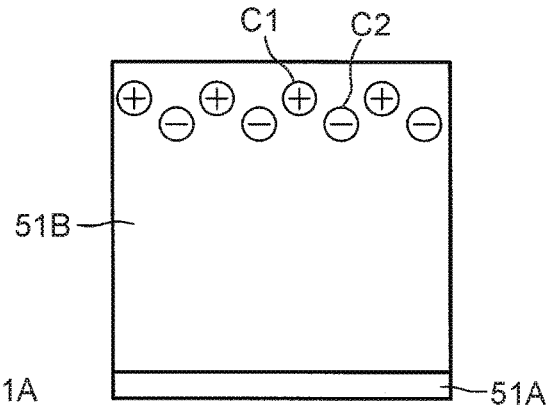

Accumulated charges may be positive and negative charges generated inside the photosensitive layer 51B due to, for example, sliding of the photosensitive drum 51 relative to the cleaning blade 57. As illustrated in FIGS. 5A and 5B, accumulated charges C1 and C2 may increase gradually every time the photosensitive drum 51 slides relative to the cleaning blade 57. The accumulated charges C1 and C2 generated as such do not tend to move freely, and therefore, it is conceivable that even if an electric field is generated and acts on the accumulated charges C1 and C2 in charging, the accumulated charges C1 and C2 do not move from their positions and may accumulate in the proximity of the outer surface of the photosensitive layer 51B.

The controller 100 is further configured to execute first charging, first exposure, developing, and transferring in the image formation. The controller 100 is further configured to execute second charging, second exposure, toner-supply suspension, second-electric-field generation in the accumulated charge removal. In other words, the controller 100 implements those operations by operating in accordance with the programs. Further, a control method executed by the controller 100 includes steps for executing the above operations.

Hereinafter, the operations executed in the image formation will be described in detail by taking one of photosensitive drums 51 involved in the monochrome mode as an example. When the image formation is performed in the color mode, the same operations are executed on all of the photosensitive drums in the image formation. The first charging is for charging the circumferential surface of the photosensitive drum 51 using the corresponding charge roller 52. More specifically, the first charging is a pre-operation or preparatory operation for the first exposure to be executed based on image data. That is, the first charging is for charging a portion of the circumferential surface of the photosensitive drum 51 to an appropriate surface potential using the scanner 40 during a period from start to end of the first exposure.

Figure 4:
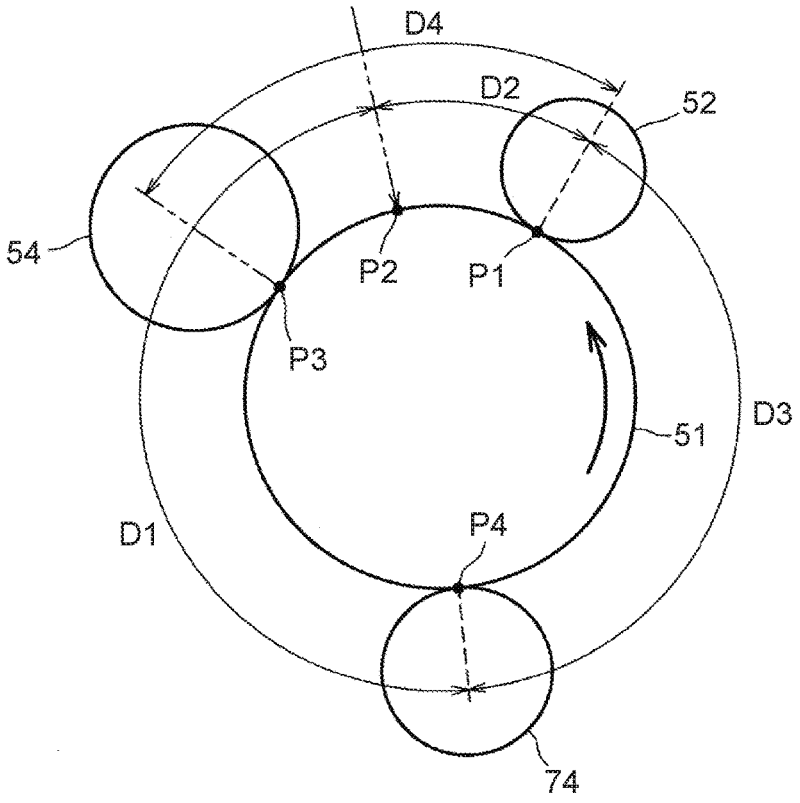
FIG. 4 illustrates a positional relationship between one of the photosensitive drums and its surrounding rollers in the first illustrative embodiment according to one or more aspects of the disclosure.

As illustrated in FIG. 4, a first position P1 is a position at which the photosensitive drum 51 and the charge roller 52 contact each other. A second position P2 is a contact point at which a laser beam emitted from the scanner 40 (refer to FIG. 1) contacts the circumferential surface of the photosensitive drum 51. The first position P1 is positioned upstream from the second position P2 in the rotating direction of the photosensitive drum 51. The first position P1 is spaced from the second position P2 by a second distance D2 in a circumferential direction of the photosensitive drum 51. Therefore, a length of a second period of time T2 required for a portion, which is positioned at the first position P1 when charging starts, of the photosensitive drum 51K to arrive at the second position P2 may be expressed by Expression (1).

$$T2=D2/S \quad (1)$$

D2: a partial circumference of the circumferential surface of the photosensitive drum 51. This partial circumference is the length of a line that extends downstream along the circumferential surface of the photosensitive drum 51 from the first position P1 to the second position P2 inclusive in the rotating direction of the photosensitive drum 51, and S: a peripheral speed of the photosensitive drum 51.

Figure 9:
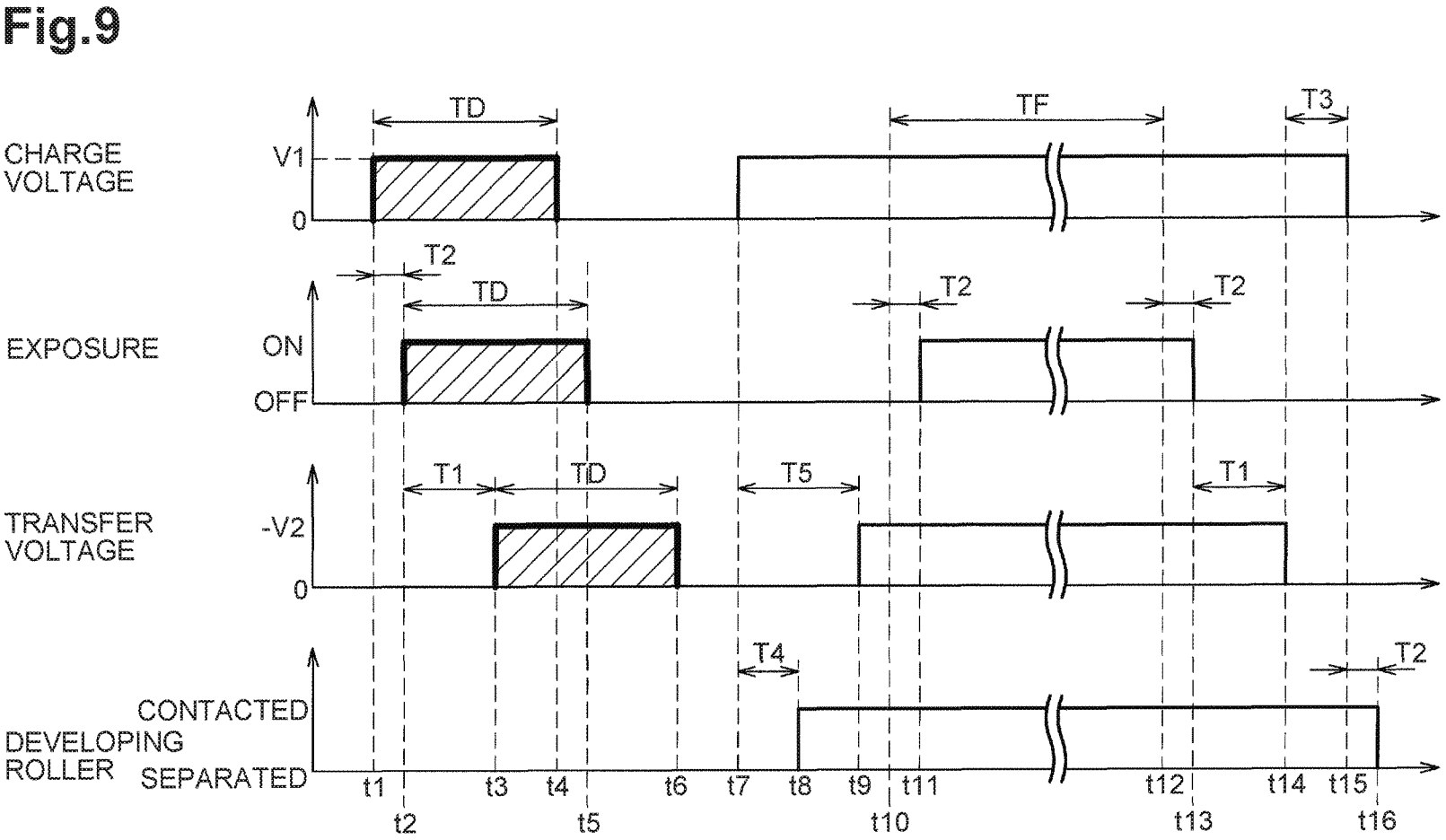
FIG. 9 is a timing diagram of the operations executed by the controller in the first illustrative embodiment according to one or more aspects of the disclosure.

Therefore, as illustrated in FIG. 9, the first charging may be executed at least for a period TF, which may last from a timing (e.g., timing t10) that is the second period T2 earlier than the start of the first exposure to a timing (e.g., timing t12) that is the second period T2 earlier than the end of the first exposure. In the illustrative embodiment, the first charging is executed for a period which lasts from timing t7, which is earlier than timing t10, to timing t15, which is later than timing t12.

The controller 100 controls the charge voltage application circuit 210 to apply a first charge voltage to the charge roller 52. More specifically, for example, in response to receipt of a print instruction, the controller 100 outputs, to the charge voltage application circuit 210, a control signal responsive to the first charge voltage. In response to the control signal outputted from the controller 100, the charge voltage application circuit 210 applies a first charge voltage to the charge roller 52. In the illustrative embodiment, the first charge voltage is a predetermined voltage V1. The predetermined voltage V1 may be, for example, 1500 V.

In the illustrative embodiment, upon lapse of a third period T3 from the end of the transferring, the controller 100 ends the first charging. The third period T3 may be expressed by Expression (2).

$$T3=D3/S \quad (2)$$

D3: a partial circumference of the circumferential surface of the photosensitive drum 51. This partial circumference is the length of a line that extends downstream along the circumferential surface of the photosensitive drum 51 from a fourth position P4 (refer to FIG. 4) to the first position P1 inclusive in the rotating direction of the photosensitive drum 51, and S: a peripheral speed of the photosensitive drum 51.

Further continuing the first charging for the third period T3 beyond the end of the transferring may enable charging of the entire circumferential surface of the photosensitive drum 51 to a predetermined surface potential uniformly, and thus the entire circumferential surface of the photosensitive drum 51 may have substantially the same surface potential when printing ends.

The first exposure is for forming an electrostatic latent image onto the circumferential surface of the photosensitive drum 51 by exposing the circumferential surface of the photosensitive drum 51 charged in the first charging. The controller 100 controls the scanner 40 to emit and stop emitting a laser beam based on image data corresponding to a print instruction to form an electrostatic latent image onto the circumferential surface of the photosensitive drum 51. A duration of an execution period of the first exposure varies according to a size of the image data to be printed. According to variations of the duration of the execution period of the first exposure, a duration of an execution period of the first charging also changes.

The developing is for forming a toner image on the circumferential surface of the photosensitive drum 51 by supplying toner onto an electrostatic latent image by the developing roller 54. The controller 100 controls the developing voltage application circuit 230 to apply a developing voltage to the developing roller 54 in the developing. The developing voltage may be, for example, 300 V.

The transferring is for transferring a toner image onto a recording medium/media such as sheet P. The controller 100 controls the transfer voltage application circuit 240 to apply a first transfer voltage to the transfer roller 74 in the transferring.

Hereinafter, the operations executed in the accumulated charge removal will be described in detail by taking one of the photosensitive drums 51 as an example although the same operations are simultaneously executed on all of the photosensitive drums 51 in the actual operations. The second charging is for charging the circumferential surface of the photosensitive drum 51 using the charge roller 52 while the photosensitive drum 51 rotates a full turn (e.g., 360 degrees) in a time period different from the execution period of the first charging. More specifically, in response to receipt of a print instruction, the controller 100 executes the second charging for a specified period TD prior to the start of the first charging (e.g., timing t7) (refer to FIG. 9). The specified period TD may be a time period required for the photosensitive drum 51 to rotate a full turn. Accordingly, the second charging starts and ends prior to start of the first charging. The controller 100 controls the charge voltage application circuit 210 to apply a second charge voltage to the charge roller 52 in the second charging. In the illustrative embodiment, the second charge voltage has the same value as the first charge voltage, i.e., the predetermined voltage V1. Nevertheless, in other embodiments, for example, the second charge voltage may be smaller or greater than the first charge voltage.

The second exposure is for, while the photosensitive drum 51 rotates a full turn, exposing, using the scanner 40, a portion, which has been charged in the second charging, of the circumferential surface of the photosensitive drum 51 to a laser beam at the second position P2 (refer to FIG. 4). More specifically, for example, upon lapse of the second period T2 from the start of the second charging, the controller 100 starts the second exposure.

The controller 100 ends the second exposure prior to start of the first charging. More specifically, for example, upon lapse of the specified period TD from the start of the second exposure, the controller 100 ends the second exposure.

The controller 100 controls the scanner 40 to expose an entire width of an image formable area of the photosensitive drum 51 in the second exposure. The width of the image formable area may correspond to a dimension of the image formable area of the photosensitive drum 51 in a direction in which an axis of the photosensitive drum 51 extends.

The second exposure is achieved if most of the width of the image formable area is exposed. In other words, in the second exposure, it may be unnecessary to expose the entire width of the image formable area. For example, not the entire width but between 70 percent and 90 percent of the entire width of the image formable area may be exposed in the second exposure.

The toner-supply suspension is for temporarily stopping supply of toner from the developing roller 54 to the photosensitive drum 51 while the second exposure portion of the photosensitive drum 51 (which has been exposed in the second exposure) passes a third position P3 (refer to FIG. 4). The third position P3 is a position at which the developing roller 54 and the circumferential surface of the photosensitive drum 51 contact each other. More specifically, in the toner-supply suspension, the controller 100 controls the developing roller moving mechanism TM to separate the developing roller 54 from the respective photosensitive drum 51.

The controller 100 starts the toner-supply suspension subsequent to the end of the transferring. More specifically, for example, the controller 100 starts the toner-supply suspension subsequent to the end of the first charging (e.g., timing t15) (refer to FIG. 9). Upon lapse of a fourth period T4 from the start of the first charging (e.g., timing t7) (refer to FIG. 9), the controller 100 ends the toner-supply suspension. That is, the controller 100 controls the developing roller moving mechanism TM to contact the developing roller 54 to the photosensitive drum 51 (e.g., timing t8). The fourth period T4 may be expressed by Expression (3).

$$T4=D4/S \quad (3)$$

D4: a partial circumference of the circumferential surface of the photosensitive drum 51. This partial circumference is the length of a line that extends downstream along the circumferential surface of the photosensitive drum 51 from the first position P1 to the third position P3 (refer to FIG. 4) inclusive in the rotating direction of the photosensitive drum 51, and S: a peripheral speed of the photosensitive drum 51.

With this control, when the portion, which has been charged at the first position P1, of the circumferential surface of the photosensitive drum 51 arrives at the third position P3, the developing roller 54 contacts the photosensitive drum 51. Therefore, this control may avoid an unnecessary toner supply to the photosensitive drum 51 from the developing roller 54.

The second-electric-field generation is for, while the photosensitive drum 51 rotates a full turn, generating, at a fourth position P4, a second electric field E2 between the cylindrical base 51A of the photosensitive drum 51 and the transfer roller 74 in the portion, which has been exposed in the second exposure, of the photosensitive drum 51. The fourth position P4 is a position at which the transfer roller 74 and the circumferential surface of the photosensitive drum 51 sandwich the conveying belt 73 therebetween. The second electric field E2 is directed toward a direction opposite to the first electric field E1 (refer to FIG. 6A) generated in the photosensitive layer 51B in the second charging.

Upon a first period T1 from the start of the second exposure lapsing, the controller 100 starts the second-electric-field generation. The first period T1 may be expressed by Expression (4).

$$T1=D1/S \quad (4)$$

D1: a partial circumference of the circumferential surface of the photosensitive drum 51. This partial circumference is the length of a line that extends downstream along the circumferential surface of the photosensitive drum 51 from the second position P2 to the fourth position P4 (refer to FIG. 4) inclusive in the rotating direction of the photosensitive drum 51, and S: peripheral speed of the photosensitive drum 51.

The controller 100 ends the second-electric-field generation prior to start of the first charging. More specifically, for example, upon the specified period TD from the start of the second-electric-field generation lapsing, the controller 100 ends the second-electric-field generation. Accordingly, in the illustrative example embodiment, all of the execution period of the second charging, the execution period of the second exposure, and the execution period of the second-electric-field generation have the same duration.

The controller 100 controls the transfer voltage application circuit 240 to apply a second transfer voltage having the same polarity as the first transfer voltage to the transfer roller 74 in the second-electric-field generation. In the illustrative embodiment, it is assumed that a constant current control is adopted in which a transfer current that passes through the transfer roller 74 is controlled to be a constant target value, as a control for transfer voltage.

In the constant current control according to the illustrative embodiment, the controller 100 monitors a value of current passing through the transfer roller 74. Based on the monitoring, the controller 100 determines a transfer voltage to be applied to the transfer roller 74 by the transfer voltage application circuit 240 and outputs a control signal to the transfer voltage application circuit 240 based on the determined transfer voltage. The value of the transfer voltage under the constant current control may vary according to types of sheets, environmental conditions (e.g., temperature and humidity), and/or the presence or absence of a sheet. Nevertheless, for convenience of explanation, in the illustrative example embodiment, the first transfer voltage and the second transfer voltage have the same value (e.g., −V2) in FIG. 9.

Nevertheless, in other embodiments, for example, the target value of the transfer current in each of the transferring and the second-electric-field generation may be the same value or respective difference values. In still other embodiments, for example, another constant voltage control may be adopted in which a constant transfer voltage may be applied to the transfer roller 74, as the control for transfer voltage. In this case, the first transfer voltage and the second transfer voltage may be the same value or have different values.

Hereinafter, principles of how to remove accumulated charges C1 and C2 from the photosensitive layer 51B will be described. It is assumed that some accumulated charges C1 and C2 are present inside the photosensitive layer 51B.

Figure 6A:
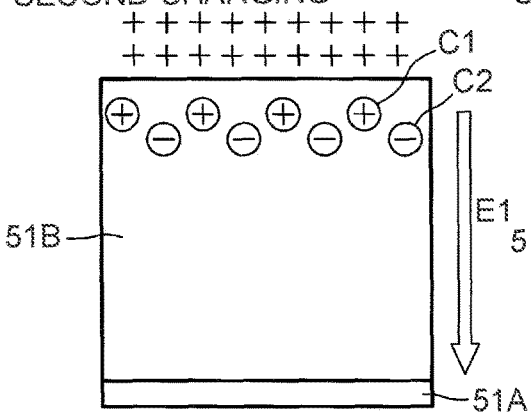
FIGS. 6A to 6E illustrate principles of how to remove accumulated charges in the first illustrative embodiment according to one or more aspects of the disclosure.

In the accumulated charge removal, as illustrated in FIG. 6A, when the second charging is executed, positive charges accumulate on the circumferential surface of the photosensitive drum 51 and thus the potential of the outer surface of the photosensitive layer 51B becomes positive. Therefore, a first electric field E1, which is directed toward the grounded cylindrical base 51A from the outer surface of the photosensitive layer 51B, is generated in the photosensitive layer 51B and acts on the accumulated charges C1 and C2. Nevertheless, the accumulated charges C1 and C2 stay at their positions.

Figure 6B:
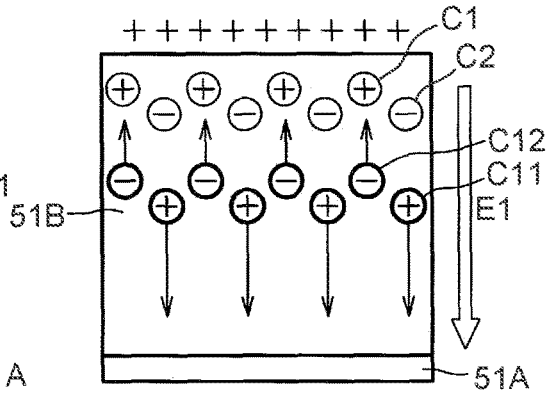

As illustrated in FIG. 6B, when the second exposure is executed subsequent to the second charging, positive charges C11 and negative charges C12 are generated in the photosensitive layer 51B. The positive charges C11 and negative charges C12 generated by exposure tend to move easily due to an effect of the first electric field E1.

Figure 6C:
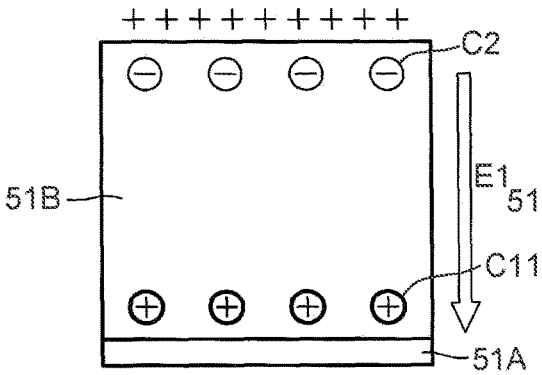

Due to the effect of the first electric field E1, the negative charges C12 move toward the outer surface of the photosensitive layer 51B. Thus, some of the negative charges C12 are attracted to the positive charges accumulating on the outer surface of the photosensitive layer 51B to cancel out each other. Some others of the negative charges C12 are attracted to the positive accumulated charges C1 in the proximity of the outer surface of the photosensitive layer 51B to cancel out each other. Thus, as illustrated in FIG. 6C, the negative accumulated charges C2 and the positive charges C11 remain in the photosensitive layer 51B after the second exposure.

Figure 6D:
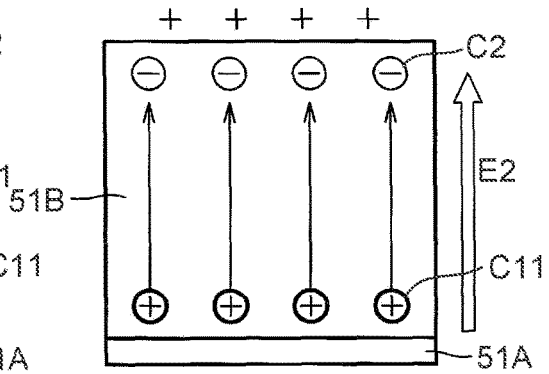
Figure 6E:
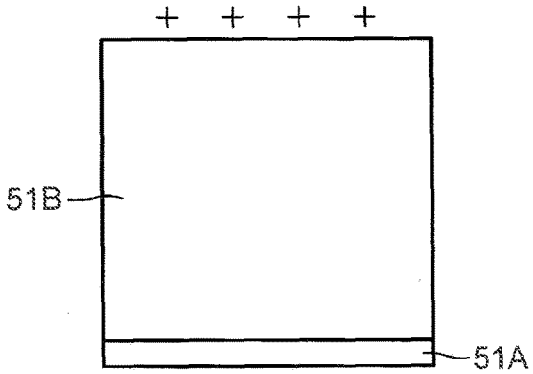

Subsequently, as illustrated in FIG. 6D, when the second-electric-field generation is executed, a second electric field E2 is generated in the photosensitive layer 51B. Thus, the positive charges C11 move toward the outer surface of the photosensitive layer 51B due to an effect of the second electric field E2. The positive charges C11 are thus attracted to the negative accumulated charges C2 remaining in the proximity of the outer surface of the photosensitive layer 51B to cancel out each other. As a result, as illustrated in FIG. 6E, substantially all of the accumulated charges C1 and C2 may be removed from the photosensitive layer 51B.

Figure 7:
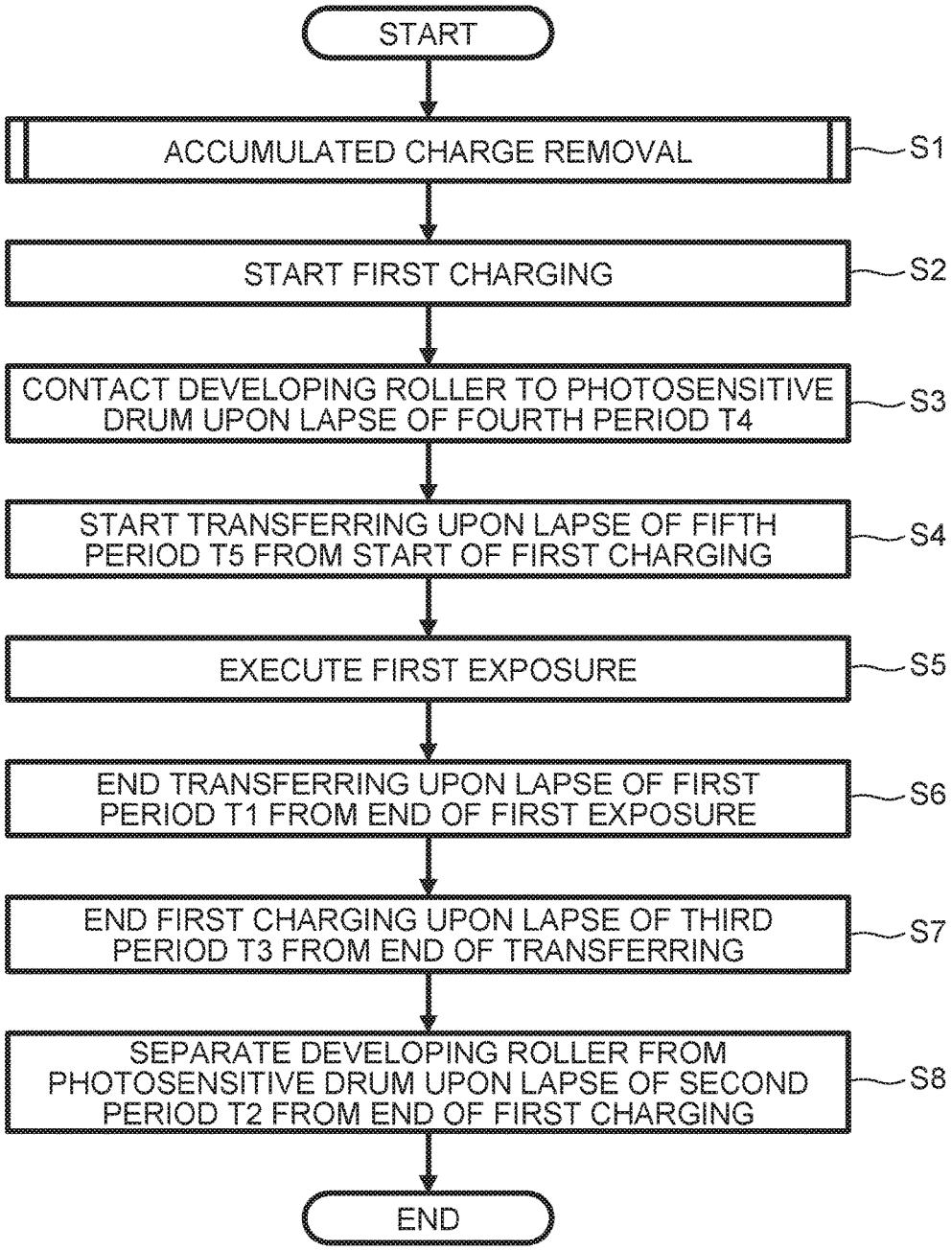
FIG. 7 is a flowchart of operations executed by a controller in the first illustrative embodiment according to one or more aspects of the disclosure.
Figure 8:
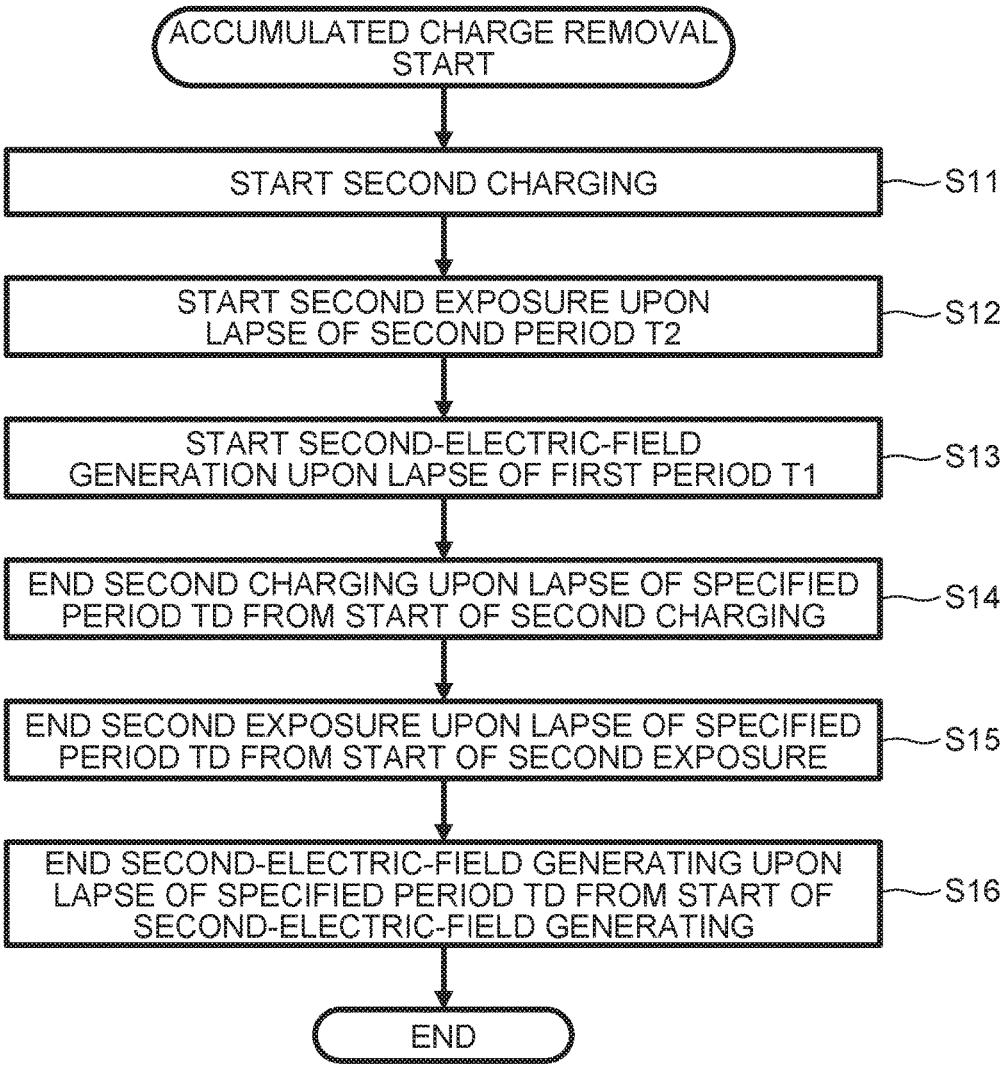
FIG. 8 is a flowchart of accumulated charge removal in the first illustrative embodiment according to one or more aspects of the disclosure.

Referring to FIGS. 7 and 8, operations to be executed by the controller 100 will be described. Until the controller 10 receives a print instruction, the controller 10 continues the toner-supply suspension, that is, the developing roller 54 is kept separated from the photosensitive drum 51.

As illustrated in FIG. 7, in response to receipt of a print instruction (e.g., START), the controller 100 executes the accumulated charge removal (e.g., step S1). As illustrated in FIG. 8, in the accumulated charge removal of step S1, the controller 100 starts the second charging (e.g., step S11).

Upon the second period T2 from the start of the second charging lapsing, the controller 100 starts the second exposure (e.g., step S12). Upon the first period T1 from the start of the second exposure lapsing, the controller 100 starts the second-electric-field generation (e.g., step S13).

Upon the specified period TD from the start of the second charging lapsing, i.e., upon completion of a full turn of the photosensitive drum 51, the controller 100 ends the second charging (e.g., step S14). Upon the specified period TD from the start of the second exposure lapsing, the controller 100 ends the second exposure (e.g., step S15). Upon the specified period TD from the start of the second-electric-field generation lapsing, the controller 100 ends the second-electric-field generation (e.g., step S16) and thus ends the accumulated charge removal.

In response to completion of the accumulated charge removal, as illustrated in FIG. 7, the controller 100 starts the first charging (e.g., step S2). Upon the fourth period T4 from the start of the first charging lapsing, the controller 100 controls the developing roller moving mechanism TM to contact the developing roller 54 to the photosensitive drum 51 (e.g., step S3). That is, in step S3, the controller 100 ends the toner-supply suspension.

Upon a fifth period T5 from the start of the first charging lapsing, the controller 100 starts the transferring (e.g., step S4). A duration of the fifth period T5 may be, for example, no shorter than a sum of the first period T1 and the second period T2. This may therefore enable application of the first transfer voltage to the portion, which has been charged at the first position P1 in the first charging, of the photosensitive drum 51, at the fourth position P4 (refer to FIG. 4). Consequently, effects of the first transfer voltage on the other portion, which has not been charged, of the photosensitive drum 51 may be avoided or minimized.

Subsequent to step S4, the controller 100 executes the first exposure (e.g., step S5). The first exposure may start any time after the second period T2 from the start of the first charging lapsing. In the illustrative embodiment, the first exposure starts subsequent to the start of the transferring.

In step S5, the controller 100 executes the first exposure based on image data included in the print instruction. Upon completion of exposure based on the last data of the image data, the controller 100 ends the first exposure.

Subsequent to step S5, upon the first period T1 from the end of the first exposure lapsing, the controller 100 ends the transferring (e.g., step S6). Subsequent to step S6, upon the third period T3 from the end of the transferring lapsing, the controller 100 ends the first charging (e.g., step S7).

Subsequent to step S7, upon the second period T2 from the end of the first charging lapsing, the controller 100 controls the developing roller moving mechanism TM to separate the developing roller 54 from the photosensitive drum 51 (e.g., step S8) and ends the ongoing control. That is, in step S8, the controller 100 starts the toner-supply suspension.

Referring to FIGS. 9 and 10, the accumulated charge removal and the image formation will be described.

As illustrated in FIG. 9, in response to receipt of a print instruction (e.g., timing t1), the controller 100 executes the second charging. When the second charging starts, the developing rollers 54 are kept separated from the respective photosensitive drums 51 by the ongoing toner-supply suspension started upon completion of the last image formation.

Figure 10A:
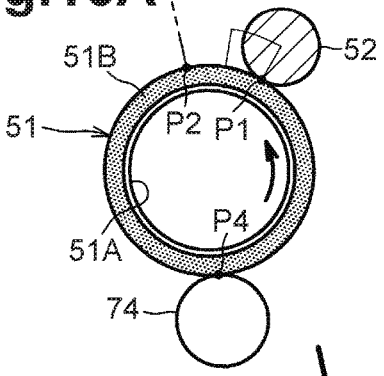
FIGS. 10A to 10H illustrate state transition of charges accumulated inside the photosensitive layer in the accumulated charge removal in the first illustrative embodiment according to one or more aspects of the disclosure.

As illustrated in FIG. 10A, in the second charging, the entire circumferential surface of the photosensitive drum 51 is positively charged as the photosensitive drum 51 rotates a full turn. In FIGS. 10A to 10H, a surface potential of the photosensitive drum 51 is indicated virtually by a thin solid line.

Figure 10B:
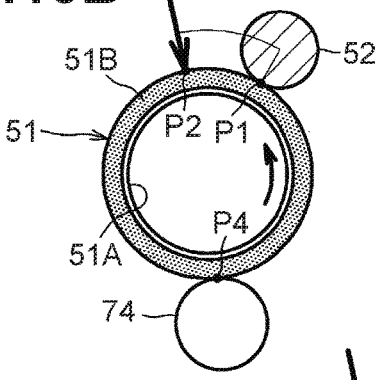

As illustrated in FIG. 9, upon the second period T2 from the start of the second charging lapsing, the controller 100 starts the second exposure (e.g., timing t2). Thus, as illustrated in FIG. 10B, when the portion charged at timing t1 when the second charging starts arrives at the second position P2, the scanner 40 starts exposing the portion charged at timing t1 to a laser beam. More specifically, for example, substantially the entire width of the image formable area is exposed in the second exposure.

Figure 10C:
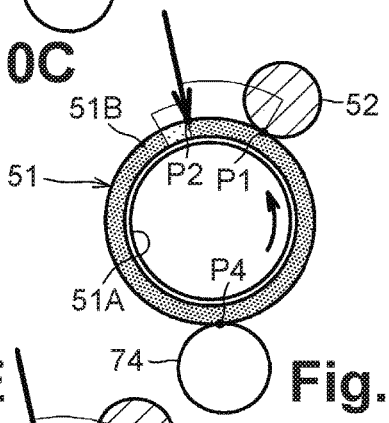

When the portion charged at timing t1 is exposed in the second exposure, as illustrated in FIG. 10C, the positive accumulated charges C1 are cancelled out by the negative charges C12 generated by exposure (refer to FIGS. 6A and 6B). In FIGS. 10A to 10H, the accumulated charges C1 and C2 in the photosensitive layer 51B are indicated by dots, and dot density may correspond to an amount of accumulated charges C1 and C2 in the photosensitive layer 51B. As the accumulated charges C1 and C2 decrease by removal, the dot density becomes lower.

Figure 10D:
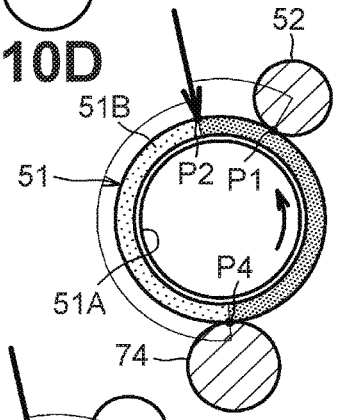
Figure 10E:
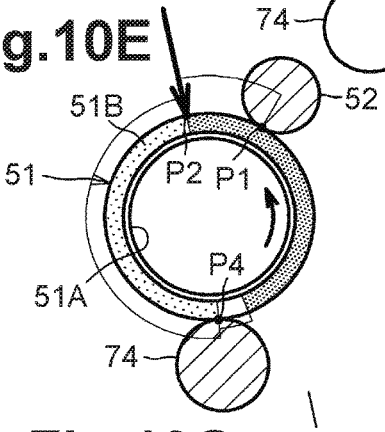

As illustrated in FIG. 9, upon expiration of the first period T1 from the start of the second exposure, the controller 100 starts the second-electric-field generation (e.g., timing t3). Thus, as illustrated in FIG. 10D, when the portion charged at timing t1 then arrives at the fourth position P4, a second transfer voltage is applied to the transfer roller 74 to generate a second electric field E2 in the portion charged at timing t1 in the photosensitive layer 51B. As illustrated in FIG. 10E, when the second electric field E2 is generated, the negative accumulated charges C2 are cancelled out by the positive charges C11 generated by exposure (refer to FIG. 6D).

Figure 10F:
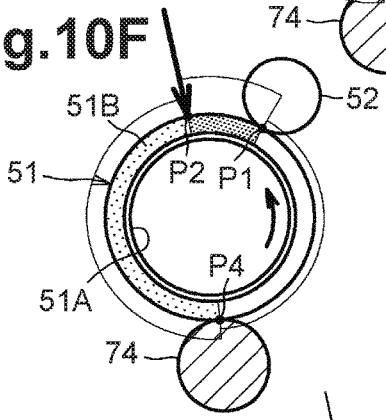

As illustrated in FIG. 9, upon expiration of the specified period TD from the start of the second charging, the controller 100 ends the second charging (e.g., timing t4). Thus, the entire circumferential surface of the photosensitive drum 51 has undergone charging in the second charging. When the second charging is completed, the charges may be distributed in the photosensitive layer 51B as shown in FIG. 10F. That is, when the photosensitive drum 51 completes a full turn from the start of the second charging, the portion charged at timing t1 when the second charging starts has already returned to the charging roller 52 via the second position P2 and the fourth position P4. Therefore, the portion that is positioned upstream from the first position P1 and downstream from the fourth position P4 in the photosensitive layer 51B in the rotating direction of the photosensitive drum 51 has undergone charging, exposure, and application of a second electric field E2, and thus the accumulated charges C1 and C2 have already been removed from the portion.

Figure 10G:
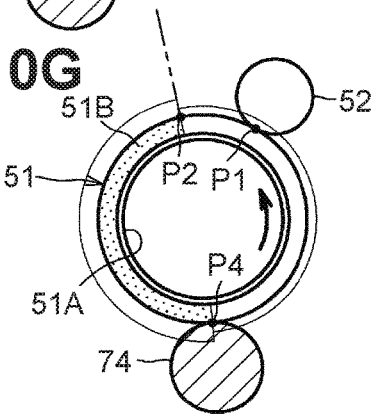
Figure 10H:
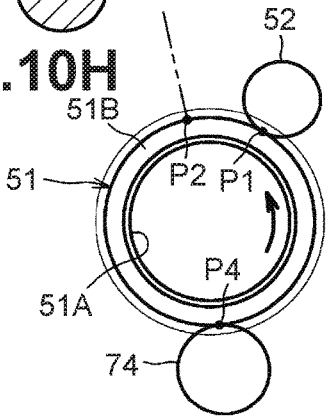

As illustrated in FIG. 9, upon expiration of the specified period TD from the start of the second exposure, the controller 100 ends the second exposure (e.g., timing t5). At this time, the entire circumferential surface of the photosensitive drum 51 has undergone the second exposure. When the second exposure is completed, the charges may be distributed in the photosensitive layer 51B as shown in FIG. 10G. That is, when the photosensitive drum 51 completes a full turn from the start of the second exposure, the portion charged at timing t1 when the second charging starts has already returned to the second position P2 via the transfer roller 74. Therefore, the portion that is positioned upstream from the second position P2 and downstream from the fourth position P4 in the photosensitive layer 51B in the rotating direction of the photosensitive drum 51 has undergone charging, exposure, and application of a second electric field E2, and thus the accumulated charges C1 and C2 have already been removed from that portion.

Upon lapse of the specified period TD from the start of the second-electric-field generation, the controller 100 ends the second-electric-field generation (e.g., timing t6). Thus, the entire circumferential surface of the photosensitive drum 51 may receive effect of the second electric field E2. When the second-electric-field generation is completed, the charges may be distributed in the photosensitive layer 51B as shown in FIG. 10F. That is, when the photosensitive drum 51 completes a full turn from the start of the second-electric-field generation, the entire portion of the photosensitive drum 51 has undergone charging, exposure, and application of a second electric field E2. Therefore, the accumulated charges C1 and C2 have been removed from the entire portion of the photosensitive layer 51B.

Thereafter, as illustrated in FIG. 9, the image formation including step S2 and subsequent steps of FIG. 7 is executed. That is, subsequent to the end of the second-electric-field generation, the controller 100 starts the first charging at an appropriate timing (e.g., timing t7). Subsequently, upon expiration of the fourth period T4 from timing t7, the controller 100 ends the toner-supply suspension, i.e., the controller 100 controls the developing roller moving mechanism TM to contact the developing roller 54 to the photosensitive drum 51 (e.g., timing t8).

Upon expiration of the fifth period T5 from timing t7, the controller 100 starts the transferring (e.g., timing t9). Subsequent to timing t9, the controller 100 executes the first exposure based on image data at an appropriate timing (e.g., timing t11).

Subsequent to completion of the first exposure executed based on the image data (e.g., timing t13), and upon expiration of the first period T1 from timing t13, the controller 100 ends the transferring (e.g., timing t14). Subsequently, upon expiration of the third period T3 from timing t14, the controller 100 ends the first charging (e.g., timing t15). Upon expiration of the second period T2 from timing t15, the controller 100 starts the toner-supply suspension, i.e., the controller 100 controls the developing roller moving mechanism TM to separate the developing roller 54 from the photosensitive drum 51, and ends the image formation.

According to the first illustrative embodiment, the following effects may be obtained.

Each of the second charging and the second exposure lasts for a duration equal to the duration of the time required for the photosensitive drum 51 rotates a full turn. Therefore, positive charges C11 and negative charges C12 may be generated by the effect of a first electric field E1 and exposure throughout the entire portion of the photosensitive layer 51B that is provided on the entire circumferential surface of the photosensitive drum 51. Consequently, positive accumulated charges C1 that respond to the first electric field E1 may be removed by the effect of the negative charges C12 and the first electric field E1 generated by exposure. The second-electric-field generation also lasts for a duration equal to the duration of the time required for the photosensitive drum 51 rotates a full turn. Therefore, a second electric field E2 that is directed toward the direction opposite to the first electric field E1 may be generated throughout the entire portion of the photosensitive layer 51B that is provided on the entire circumferential surface of the photosensitive drum 51. Consequently, negative accumulated charges C2 that respond to the second electric field E2 may be removed by the effect of the positive charges C11 and the second electric field E2 generated by exposure.

The second-electric-field generation is implemented using the transfer roller 74 such that a second transfer voltage having the same polarity as a first transfer voltage is applied to the transfer roller 74. Therefore, as compared with a case where a member for generating a second electric field is provided separate from the transfer roller 74, the configuration according to the first illustrative embodiment may enable removal of the accumulated charges C1 and C2 with a simpler configuration.

The controller 100 starts the second-electric-field generation upon expiration of the first period T1 from the start of the second exposure. Therefore, as compared with a case where the controller 100 starts the second-electric-field generation prior to expiration of the first period T1 from the start of the second exposure, the configuration according to the first illustrative embodiment may avoid needless execution of the second-electric-field generation, thereby minimizing power consumption.

The controller 100 starts the second exposure upon expiration of the second period T2 from the start of the second charging. Therefore, as compared with a case where the controller 100 starts the second exposure prior to expiration of the second period T2 from the start of the second charging, the configuration according to the first illustrative embodiment may avoid needless execution of the second exposure, thereby minimizing power consumption.

In the toner-supply suspension, the developing rollers 54 are separated from the photosensitive drums 51 and are kept in the separated state. Therefore, toner supply from the developing rollers 54 to the respective photosensitive drums 51 may be effectively stopped temporarily.

In response to receipt of a print instruction, all of the second charging, the second exposure, and the second-electric-field generation included in the accumulated charge removal are executed prior to the start of the first charging for printing in accordance with the print instruction. Therefore, even if the surface potential of the photosensitive drum 51 is already lost due to expiration of a long period of time from the last printing, accumulated charges C1 and C2 may be removed sufficiently by execution of the accumulated charge removal starting with the second charging in response to receipt of a print instruction.

In the first illustrative embodiment, the duration of the execution period of the second charging, the duration of the execution period of the second exposure, and the duration of the execution period of the second-electric-field generation are equal to each other. Therefore, each of the second charging, the second exposure, and the second-electric-field generation may be avoided to be executed needlessly.

[Second Illustrative Embodiment]

A second illustrative embodiment will be described with reference to appropriate accompanying drawings. In the second illustrative embodiment, details of the operations to be executed by the controller 100 may be different from those according to the first illustrative embodiment. Common components or steps have the same reference numerals or step numbers as those of the first illustrative embodiment, and the detailed description of the common components or steps is omitted.

Figure 11:
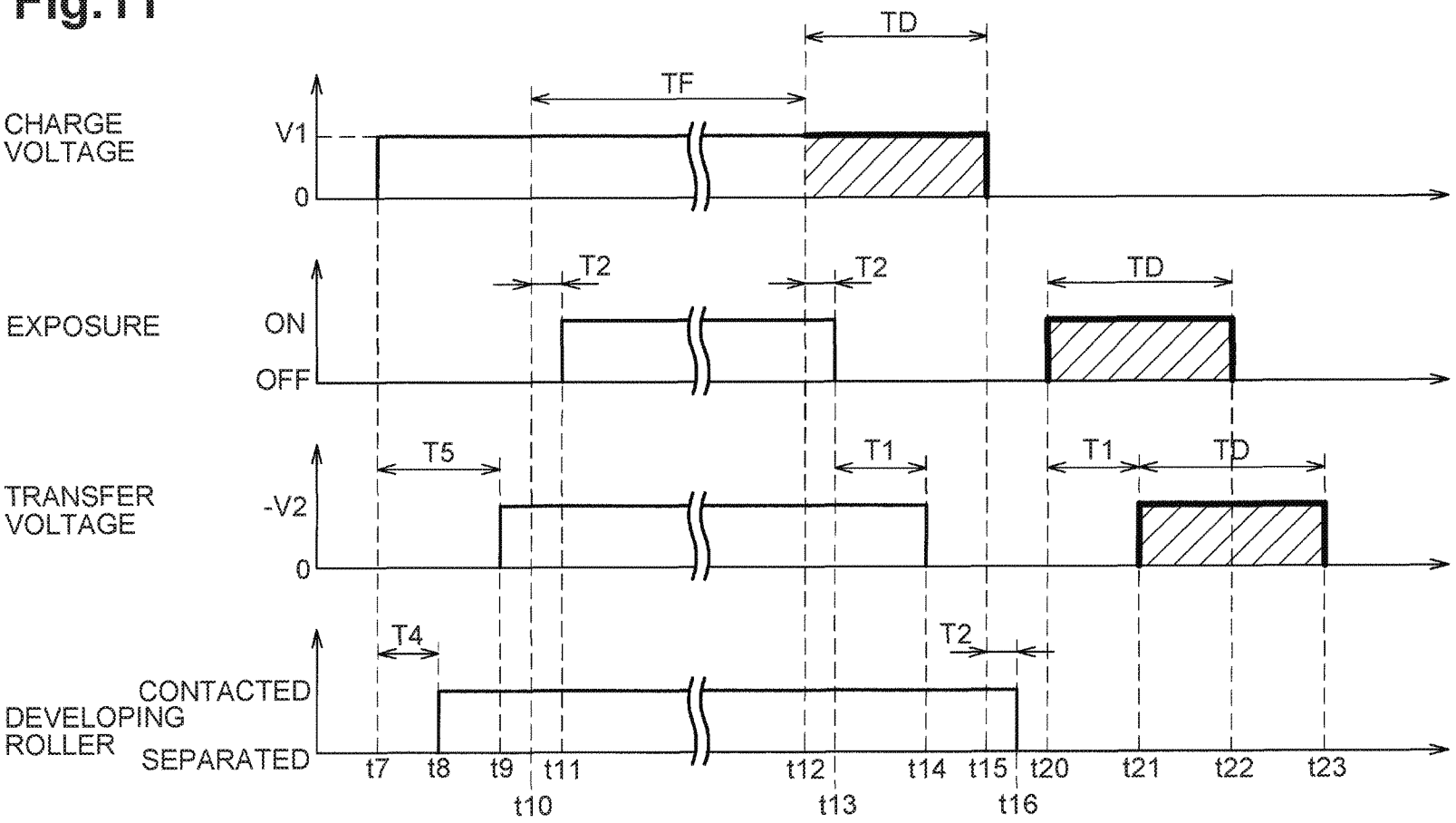
FIG. 11 is a timing diagram of operations executed by the controller in a second illustrative embodiment according to one or more aspects of the disclosure.

In the second illustrative embodiment, as illustrated in FIG. 11, the controller 100 starts the second charging during execution of the transferring (e.g., between timing t9 and timing 14), and executes the second exposure and the second-electric-field generation subsequent to start of the toner-supply suspension (e.g., timing 16). The execution period of the first charging includes the period TF and lasts from timing t7 to timing t12. The second charging is executed continuously from or immediately subsequent to the end of the first charging.

Figure 12:
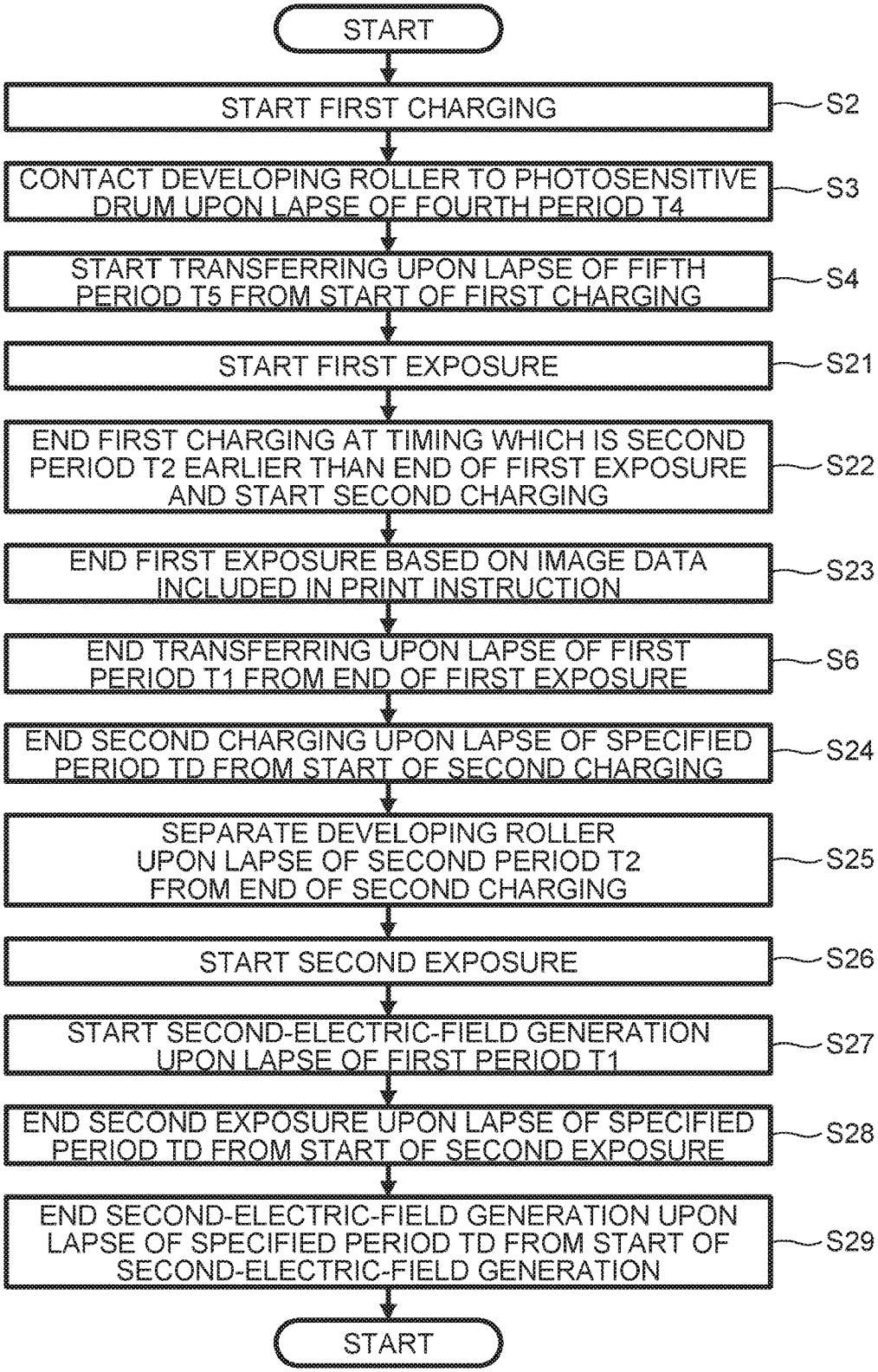
FIG. 12 is a flowchart of the operations executed by the controller in the second illustrative embodiment according to one or more aspects of the disclosure.

Referring to FIG. 12, operations to be executed by the controller 100 according to the second illustrative embodiment will be described. The flowchart of FIG. 12 includes steps S2, S3, S4, and S6 that are the same as the flowchart of FIG. 7 according to the first illustrative embodiment. The flowchart of FIG. 12 includes other steps S21 to S29 that are different from the flowchart of FIG. 7 according to the first illustrative embodiment.

As illustrated in FIG. 12, in response to receipt of a print instruction (e.g., START), the controller 100 executes steps S2, S3, and S4 in this order successively. Subsequent to step S4, the controller 100 executes the first exposure based on image data (e.g., step S21).

Subsequent to step S21, the controller 100 ends the first charging at a timing which may be the second period T2 earlier than the end of the first exposure, and executes the second charging upon the end of the first charging (e.g., step S22). The controller 100 may be enabled to determine, based on the image data, the duration of the execution period of the first exposure in advance. Therefore, when the controller 100 receives a print instruction, the controller 100 may appropriately determine the timing which may be the second period T2 earlier than the end of the first exposure. More specifically, for example, in a case where the controller 100 determines, based on image data, the duration of the execution period of the first exposure as an execution period TA, the charging is changed from the first charging to the second charging upon expiration of a time period (e.g., TA-T2) from the start of the first exposure.

Similar to the first illustrative embodiment, in the second illustrative embodiment, the charge voltage applied in the first charging and the charge voltage applied in the second charging are specified as the same value. Therefore, in step S22, the same charge voltage is applied continuously from the first charging to the second charging. Nevertheless, in a case where the charge voltage applied in the first charging and the charge voltage applied in the second charging are specified as different values, in step S22, the value of the charge voltage may be changed between the first charging and the second charging.

Subsequent to step S22, the controller 100 ends the first exposure based on the image data (e.g., step S23) and the routine proceeds to step S6. Subsequent to step S6, upon expiration of the specified period TD from the start of the second charging, the controller 100 ends the second charging (e.g., step S24).

Subsequent to step S24, and upon expiration of the second period T2 from the end of the second charging, the controller 100 starts the toner-supply suspension, i.e., the controller 100 controls the developing roller moving mechanism TM to separate the developing roller 54 from the photosensitive drum 51 (e.g., step S25). Subsequent to step S25, the controller 100 starts the second exposure at an appropriate timing (e.g., step S26).

Subsequent to step S26, and upon expiration of the first period T1 from the start of the second exposure, the controller 100 starts the second-electric-field generation (e.g., step S27). Subsequent to step S27, and upon expiration of the specified period TD from the start of the second exposure, the controller 100 ends the second exposure (e.g., step S28). Subsequent to step S28, upon lapse of the specified period TD from the start of the second-electric-field generation, the controller 100 ends the second-electric-field generation (e.g., step S29) and thus ends the ongoing control.

According to the second illustrative embodiment, the following effects may be obtained.

In the second illustrative embodiment, subsequent to the first charging for printing, the second charging, the second exposure, and the second-electric-field generation are executed. Therefore, prior to start of the next printing, accumulated charges C1 and C2 may be removed from the inside of the photosensitive layer 51B. Accordingly, an interval between receipt of a print instruction and the start of printing may be shortened.

[Third Illustrative Embodiment]

A third illustrative embodiment will be described with reference to appropriate accompanying drawings. In the third illustrative embodiment, some configuration and details of the operations to be executed by the controller 100 may be different from those according to the first illustrative embodiment. Common components or steps have the same reference numerals or step numbers as those of the first illustrative embodiment, and the detailed description of the common components or steps is omitted.

Figure 13:
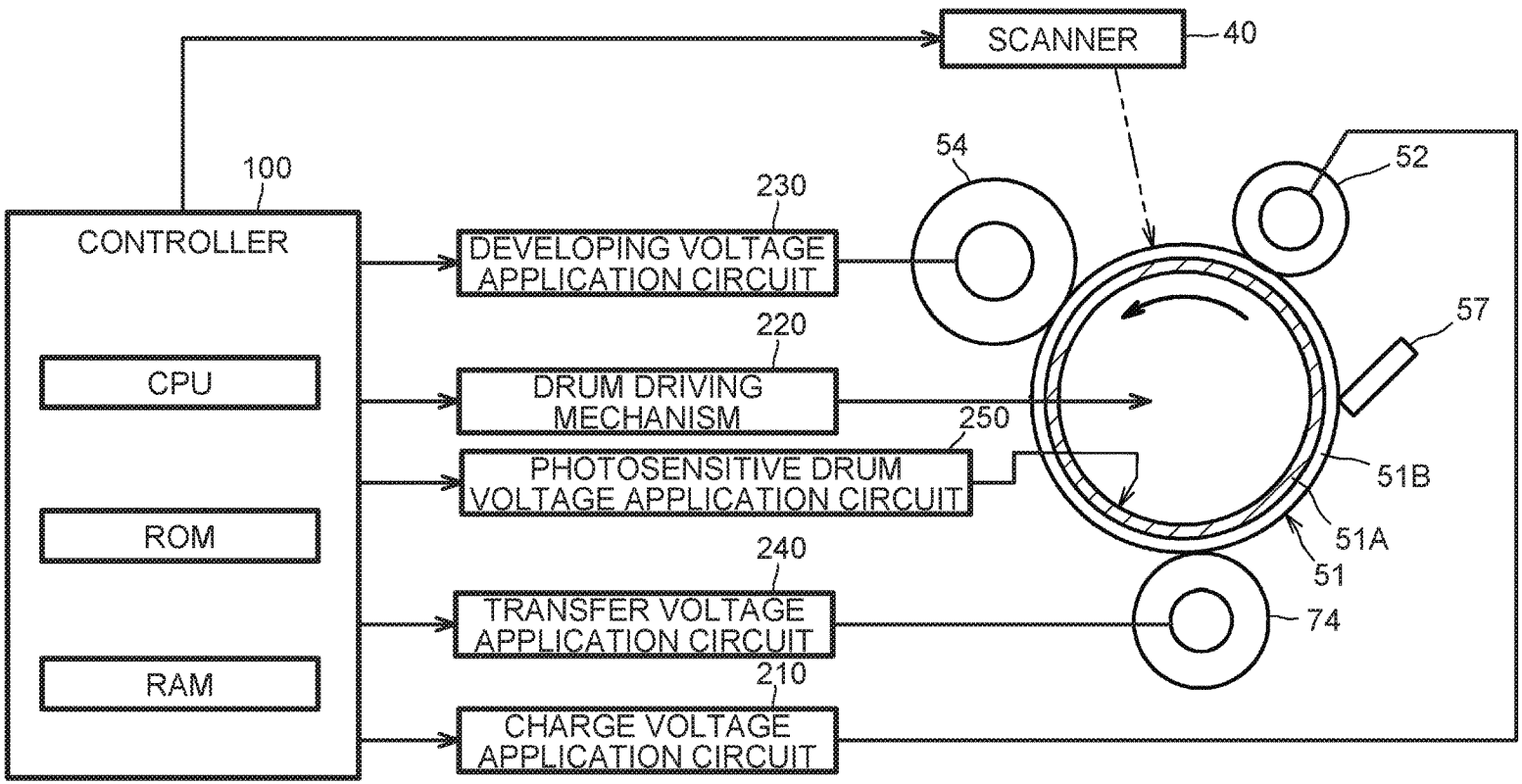
FIG. 13 illustrates an internal configuration of the color printer in a third illustrative embodiment according to one or more aspects of the disclosure.

As illustrated in FIG. 13, the color printer 1 further includes a photosensitive drum voltage application circuit 250 for applying a positive drum voltage to the cylindrical base 51A of the photosensitive drum 51. That is, the photosensitive drum voltage application circuit 250 is configured to apply a drum voltage, which has the same polarity as the charge voltage to be applied to the charge roller 52 in the second charging, to the cylindrical base 51A of the photosensitive drum 51.

Figure 14:
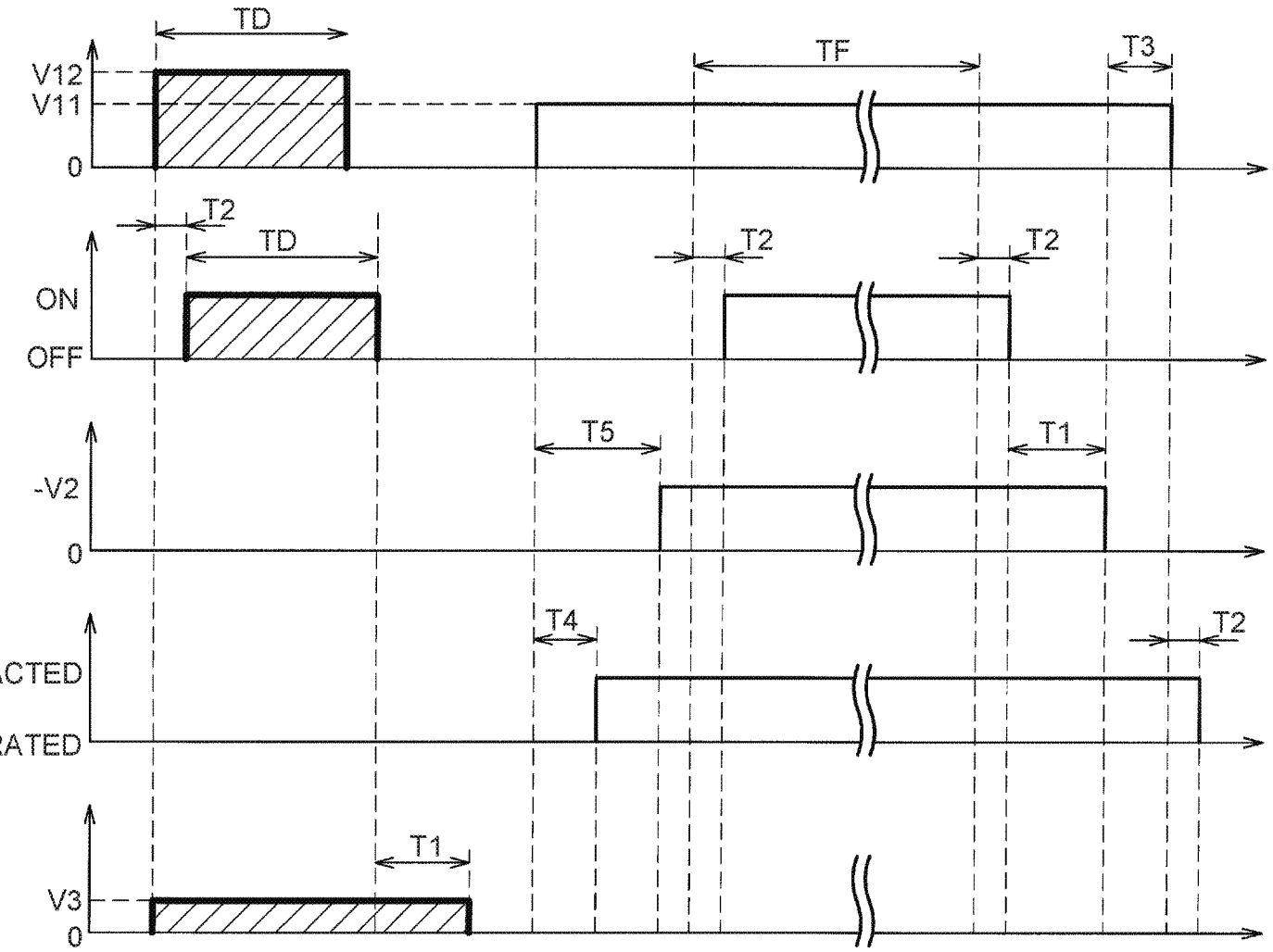
FIG. 14 is a timing diagram of operations executed by the controller in the third illustrative embodiment according to one or more aspects of the disclosure.

As illustrated in FIG. 14, in the second-electric-field generation, the controller 100 controls the photosensitive drum voltage application circuit 250 to apply a positive drum voltage V3 to the cylindrical base 51A but does not control the transfer voltage application circuit 240 to apply a transfer voltage to the transfer roller 74. The drum voltage V3 is smaller than the charge voltage (e.g., a first charge voltage V11) to be applied to the charge roller 52. In the third illustrative embodiment, the transfer roller 74 that does not apply a transfer voltage in the second-electric-field generation corresponds to the electric field generating member.

The controller 100 starts the second charging and the second-electric-field generation at the same timing. In the second charging, the controller 100 controls the charge voltage application circuit 210 to apply a second charge voltage V12, which is greater than the first charge voltage V11 to be applied in the first charging, to the charge roller 52. In the third illustrative embodiment, the second charge voltage V12 may be equal to a sum of the first charge voltage V11 and the drum voltage V3. For example, the first charge voltage V11 may be 1500 V, the drum voltage V3 may be 200 V, and the second charge voltage may be 1700 V.

Figure 15:
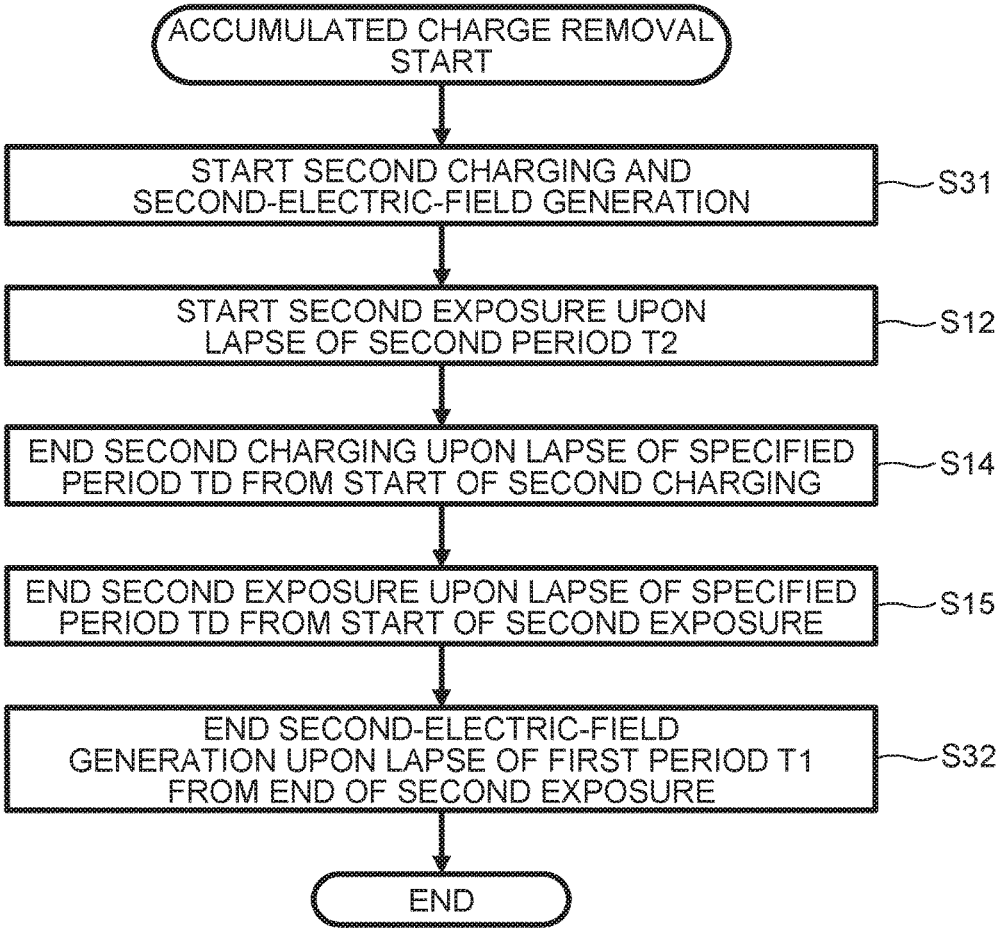
FIG. 15 is a flowchart of the operations executed by the controller in the third illustrative embodiment according to one or more aspects of the disclosure.

Referring to FIG. 15, operations to be executed by the controller 100 according to the third illustrative embodiment will be described. Accumulated charge removal of FIG. 15 includes different steps from the accumulated charge removal of FIG. 8 according to the first illustrative embodiment. The flowchart of FIG. 15 includes steps S12, S14, and S15 that are the same as the flowchart of FIG. 8. The flowchart of FIG. 15 includes other steps S31 and S32 that are different from the flowchart of FIG. 8.

In response to receipt of a print instruction (e.g., START), the controller 100 executes the processing operation of FIG. 7. When the controller 100 executes the accumulated charge removal (e.g., step S1), the controller 100 executes steps of the flowchart of FIG. 15.

In the accumulated charge removal, the controller 100 starts the second charging and the second-electric-field generation at the same timing (e.g., step S31). That is, in step S31, while the second charge voltage V12 is applied to the charge roller 52, the drum voltage V3 is applied to the cylindrical base 51A of the photosensitive drum 51. Thus, a potential difference in the photosensitive layer 51B between its outer surface and its inner surface, which is in contact with the outer circumferential surface of the cylindrical base 51A, becomes a value of V12−V3, i.e., the same as the first charging voltage V11, at the first position P1. Therefore, the circumferential surface of the photosensitive drum 51 is charged to the same potential as the surface potential at printing, at the first position P1.

Meanwhile, at the fourth position P4, a second electric field E2, which is directed toward the transfer roller 74 from the cylindrical base 51A, is generated in the photosensitive layer 51B because no transfer voltage is applied to the transfer roller 74.

Subsequent to step S31, the controller 100 executes steps S12, S14, and S15 in this order successively. In step S12, the controller 100 starts the second exposure. That is, exposure to the portion that has been charged when the second charging starts is started, and therefore, positive accumulated charges C1 are removed from the photosensitive layer 51B due to the effect of a first electric field E1. When the portion that has been charged when the second charging starts then arrives at the fourth position P4, negative accumulated charges C2 are removed from the photosensitive layer 51B due to the effect of a second electric field E2.

Subsequent to step S15, upon lapse of the first period T1 from the end of the second exposure, the controller 100 ends the second-electric-field generation (e.g., step S32) and ends the ongoing control. That is, after application of a second electric field E2 at the fourth position P4 to a trailing end of the exposed portion exposed in the second exposure, i.e., the portion that just passed the second position P2 when the second exposure ends, is completed, the controller 100 ends the second-electric-field generation.

According to the third illustrative embodiment, the following effects may be obtained.

Since the drum voltage V3 is applied to the cylindrical base 51A in the second-electric-field generation, the accumulated charges may be removed without application of a transfer voltage.

The controller 100 starts the second charging and the second-electric-field generation at the same timing. Therefore, the potential difference between the charge roller 52 and the photosensitive drum 51 at the second charging may be avoided to become too greater than the potential difference therebetween at printing.

[Fourth Illustrative Embodiment]

A fourth illustrative embodiment will be described with reference to appropriate accompanying drawings. In the fourth illustrative embodiment, details of the operations to be executed by the controller 100 may be different from those according to the third illustrative embodiment. Common components or steps have the same reference numerals or step numbers as those of the third illustrative embodiment, and the detailed description of the common components or steps is omitted.

Figure 16:
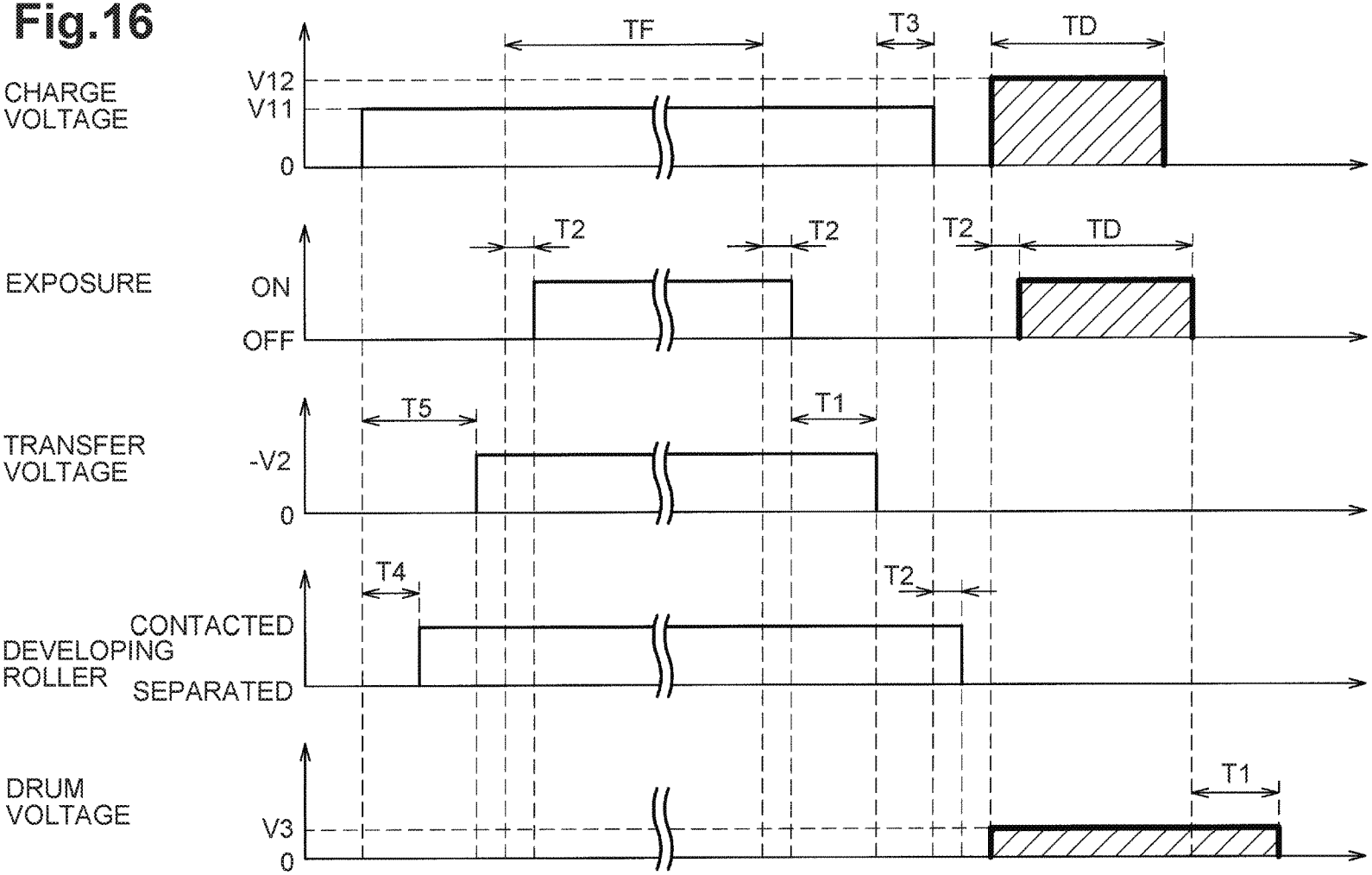
FIG. 16 is a timing diagram of operations executed by the controller in a fourth illustrative embodiment according to one or more aspects of the disclosure.
Figure 17:
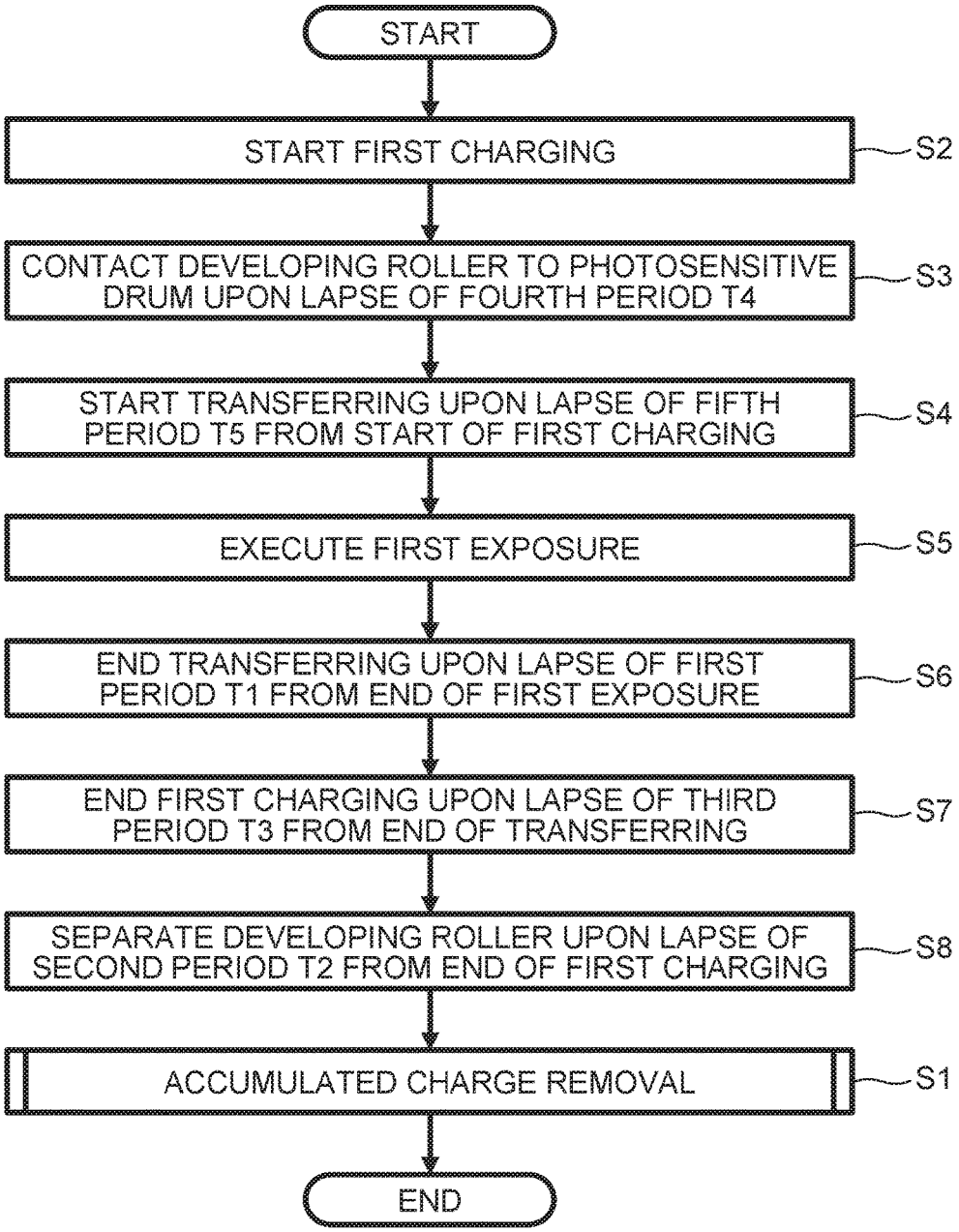
FIG. 17 is a flowchart of the operations executed by the controller in the fourth illustrative embodiment according to one or more aspects of the disclosure.

As illustrated in FIG. 16, the controller 100 executes the accumulated charge removal according to the fourth illustrative embodiment subsequent to the first charging, more specifically, at an appropriate timing after starting the toner-supply suspension. In the fourth illustrative embodiment, as illustrated in FIG. 17, although the sequence of steps is different from the first illustrative embodiment (refer to FIG. 7), the details of steps S2 to S8 are the same as their corresponding steps according to the first illustrative embodiment. For example, in the fourth illustrative embodiment, step S1 is executed subsequent to step S8. According to the fourth illustrative embodiment, the same effects as those obtained by the second illustrative embodiment may be obtained.

While the disclosure has been described in detail with reference to the specific embodiments thereof, these are merely examples, and various changes, arrangements and modifications may be applied therein without departing from the spirit and scope of the disclosure.

The timing at which the developing rollers 54 are separated from the respective photosensitive drums 51, that is, the timing at the toner-supply suspension is started, may be any timing after a trailing end of the exposed portion exposed in the first exposure executed based on image data, i.e., the portion that just passed the second position P2 when the first exposure ends, arrived at the third position P3. Similar to this, the timing at which the toner-supply suspension ends may be any timing after a trailing end of the charged portion charged by the charge roller 52, i.e., the portion that just passed the first position P1 when the charging ends, arrived at the third position P3.

The start timing and/or the duration of the execution period of each of the second charging, the second exposure, and the second-electric-field generation are not limited to the specific embodiments, but in other embodiments, for example, may be specified appropriately. For example, in the first illustrative embodiment, the second charging, the second exposure, and the second-electric-field generation may be started at the same timing. Nevertheless, if the second-electric-field generation is started earlier than the timing according to the first illustrative embodiment, a negative surface potential may be generated partially on the circumferential surface the photosensitive drum 51. Therefore, although the portion having the negative surface potential passes the charge roller 52 once, the surface potential of the circumferential surface of the photosensitive drum 51 is still uneven, that is, the portion having the negative surface potential might not become a preferable potential. In such a case, the duration of the execution period of the second charging may be extended until the surface potential of the negatively charged portion becomes a preferable potential.

In an example in each illustrative embodiment, the first charging and the second charging may be executed successively at respective timings with no interval between their timings. In another example, the first charging and the second charging may be executed separately at respective timings with an interval during which the charge voltage is 0 (zero) being provided between their timings. Similar to this, the first exposure and the second exposure may be executed successively at respective timings with no interval between their timings or may be executed separately at respective timings with an interval being provided therebetween. The second-electric-field generation and the transferring may be executed successively at respective timings with no interval between their timings or may be executed separately at respective timings with an interval being provided therebetween.

The developer is not limited to positively charged toner, but in other embodiments, for example, may be negatively charged toner. If negatively charged toner is used, the polarity of each voltage applied in each of the illustrative embodiments may be changed to be opposite. In such a case, in one example, the absolute value of the charge voltage applied in the second charging may be specified to be greater than the absolute value of the charge voltage to be applied in the first charging in the third and fourth illustrative embodiments. In another example, the absolute value of the drum voltage may be specified to be smaller than the absolute value of the charge voltage to be applied to the charge roller 52 in the third and fourth illustrative embodiment.

The photosensitive member is not limited to the photosensitive drum 51, but in other embodiments, for example, may be a belt-shaped member.

The charger is not limited to the charge roller 53, but in other embodiments, for example, may be a corona discharge charger disposed remote from the photosensitive drum. That is, the charger may include a charge wire and a grid electrode.

The exposure device is not limited to the scanner 40, but in other embodiments, for example, may be an LED unit for exposing a photosensitive member using an LED or a static eliminator for removing static charges from the circumferential surface of the photosensitive member.

The developing unit is not limited to the developing unit 520 including the developing roller 54 contactable to the photosensitive drum 51, but in other embodiments, for example, may be a non-contactable developing unit disposed apart from the photosensitive drum 51 and including no contactable member or portion contactable to the photosensitive drum 51.

The transfer member is not limited to the transfer roller 74, but in other embodiments, for example, may be a non-contactable transfer member disposed apart from the photosensitive drum.

The electric field generating member is not limited to the transfer roller 74 or the photosensitive drum 51, but in other embodiments, for example, may be the cleaning blade 57 or an non-contactable transfer member.

The toner-supply suspension is not limited to the specific embodiment in which the developing roller 54 is separated from the photosensitive drum 51. Nevertheless, in other embodiments, for example, the toner-supply suspension may be implemented such that the developing voltage applied to the developing roller is changed to a smaller voltage than the surface potential of the exposed portion of the photosensitive drum to temporarily stop toner supply to the photosensitive drum from the developing roller.

The image forming apparatus is not limited to the color printer 1, but in other embodiments, for example, may be a monochrome printer, a copying machine, and a multifunction device.

The transfer-receiving medium is not limited to a sheet P, but in other embodiments, for example, may be a belt that may contact the photosensitive drum in an intermediate-transfer type printer.

The one or more aspects of the disclosure may be implemented in various combinations of the elements described in the illustrative embodiments and variations.

What is claimed is:

1. An image forming apparatus comprising:

an image forming unit including:

a photosensitive member having a photosensitive layer;

a charger configured to charge a circumferential surface of the photosensitive member to generate a first electric field in the photosensitive layer;

an exposure device comprising a light source, the exposure device configured to expose the circumferential surface of the photosensitive member; and a developing unit configured to supply developer onto the circumferential surface of the photosensitive member; and an electric circuit electrically connected to the image forming unit and configured to apply a voltage to generate, in conjunction with an electric field generating member, a second electric field in the photosensitive layer, wherein the second electric field is directed in a direction opposite to the first electric field, wherein the image forming unit is configured to perform a printing process in which an image is formed on a recording medium, the printing process including a first charging, a first exposure, and a toner supplying in which toner is supplied from the developing unit to the photosensitive member; and a controller electrically connected to the image forming unit, the controller configured to perform:

second charging in a period different from an execution period of the first charging and while the photosensitive member rotates at least a full turn, the second charging including controlling the charger to charge a portion of the circumferential surface of the photosensitive member, thereby generating the first electric field in a corresponding portion of the photosensitive layer;

second exposure while the photosensitive member rotates at least a full turn, the second exposure including controlling the exposure device to expose the portion, which has been charged in the second charging, of the circumferential surface of the photosensitive member;

toner-supply suspension before the portion, which has been exposed in the second exposure, of the circumferential surface of the photosensitive member passes a position at which developer from the developing unit is configured to initially adhere to the circumferential surface of the photosensitive member, the toner-supply suspension including controlling the developing unit to stop supplying the developer to the circumferential surface of the photosensitive member; and second-electric-field generation while the photosensitive member rotates at least a full turn, the second-electric-field generation including controlling the electric circuit to apply the voltage to generate the second electric field in the corresponding portion of the photosensitive layer when the portion, which has been charged in the second charging and subsequently exposed in the second exposure, of the circumferential surface of the photosensitive member reaches a position facing the electric field generating member.

2. The image forming apparatus according to claim 1, further comprising:

a transfer member electrically connected to the controller and configured to transfer a developer image onto the recording medium from the circumferential surface of the photosensitive member, wherein the electric field generating member is the transfer member, wherein the electric circuit is a transfer voltage application circuit electrically connected to the transfer member and the controller and configured to apply a transfer voltage to the transfer member, wherein the controller is further configured to perform:

transferring, including controlling the transfer voltage application circuit to apply a first transfer voltage to the transfer member for transferring the developer image onto the recording medium, and wherein, in the second-electric-field generation, controlling the electric circuit to apply the voltage includes controlling the transfer voltage application circuit to apply the voltage to the transfer member, wherein the voltage applied to the transfer member is a second transfer voltage having the same polarity as the first transfer voltage.

3. The image forming apparatus according to claim 2, wherein the controller is further configured to start the second-electric-field generation upon expiration of a first period T1 from a start of the second exposure, and wherein the first period T1 satisfies an equation of T1=D1/S, where D1 is a partial circumference of the photosensitive member, the partial circumference being a length of a circumferential line that extends from the position which is a point at which a light emitted by the light source intersects with a circumference of the photosensitive member to the position at which the circumferential surface of the photosensitive member faces the transfer member, and S is a peripheral speed of the photosensitive member.

4. The image forming apparatus according to claim 1, wherein the photosensitive member further includes a cylindrical base whose outer circumferential surface has the photosensitive layer formed thereon, wherein the electric circuit is a photosensitive drum voltage application circuit electrically connected to the cylindrical base and the controller, the photosensitive drum voltage application circuit configured to apply a drum voltage to the cylindrical base, and wherein, in the second-electric-field generation, controlling the electric circuit to apply the voltage includes controlling the photosensitive drum voltage application circuit to apply, to the cylindrical base, the drum voltage having the same polarity as a charge voltage that is applied to the charger in the second charging.

5. The image forming apparatus according to claim 4, wherein an absolute value of the drum voltage is smaller than an absolute value of the charge voltage to be applied to the charger in the second charging.

6. The image forming apparatus according to claim 5, wherein the absolute value of the charge voltage to be applied to the charger in the second charging is greater than an absolute value of the charge voltage to be applied to the charger in the first charging.

7. The image forming apparatus according to claim 6, wherein the controller is further configured to start the second charging and the second-electric-field generation at the same timing.

8. The image forming apparatus according to claim 1, wherein the controller is further configured to, upon expiration of a second period T2 from the start of the second charging, start the second exposure, and wherein the second period T2 satisfies an equation of T2=D2/S, where D2 is a partial circumference of the photosensitive member, the partial circumference being a length of a circumferential line that extends from a position along the circumference of the photosensitive member at which the charger generates the first electric field to a position which is a point at which a light emitted from the light source intersects with the circumference of the photosensitive member, and S is a peripheral speed of the photosensitive member.

9. The image forming apparatus according to claim 8, wherein the position at which the charger generates the first electric field corresponds to a position at which the charger and the circumferential surface of the photosensitive member contact with each other.

10. The image forming apparatus according to claim 1, wherein the controller is further configured to, in the toner-supply suspension, move a developing roller of the developing unit from a first position, at which the developing roller and the circumferential surface of the photosensitive member contact with each other, to a second position, at which the developing roller is out of contact with the circumferential surface of the photosensitive member, and to maintain the developing roller in the second position.

11. The image forming apparatus according to claim 10, further comprising:

a transfer member electrically connected to the controller and configured to transfer a developer image onto the recording medium from the circumferential surface of the photosensitive member, wherein the controller is further configured to perform:

transferring including controlling the transfer member to transfer the developer image onto the recording medium; and subsequent to the end of the transferring, control the developing roller to move from the first position to the second position and to stay in the second position.

12. The image forming apparatus according to claim 1, wherein the controller is further configured to, in response to receipt of a print instruction, and prior to the start of the first charging, start and end each of the second charging, the second exposure, and the second-electric-field generation.

13. The image forming apparatus according to claim 1, further comprising:

a transfer member electrically connected to the controller and configured to transfer a developer image onto the recording medium from the circumferential surface of the photosensitive member, wherein the controller is further configured to perform:

transferring, including controlling the transfer member to transfer the developer image onto the recording medium;

start the second charging during execution of the transferring; and subsequent to the start of the toner-supply suspension, start the second exposure and the second-electric-field generation.

14. The image forming apparatus according to claim 1, wherein a duration of an execution period of the second charging, a duration of an execution period of the second exposure, and a duration of an execution period of the second-electric-field generation are equal to each other.

15. The image forming apparatus according to claim 1, wherein the second exposure ends after the second charging ends.

16. A control method to be executed by a controller of an image forming apparatus, the image forming apparatus configured to perform a printing process on a recording medium, the printing process including a first charging, a first exposure, and a toner supplying in which toner is supplied from a developing unit to a photosensitive member of the image forming apparatus, the photosensitive member having a photosensitive layer, the control method comprising:

second charging while the photosensitive member rotates at least a full turn, the second charging including controlling a charger of the image forming apparatus to charge a portion of a circumferential surface of a photosensitive member of the image forming apparatus in a period different from an execution period of the first charging, wherein the charger is configured to charge the circumferential surface of the photosensitive member to generate a first electric field in a corresponding portion of the photosensitive layer;

second exposure while the photosensitive member rotates at least a full turn, the second exposure including controlling an exposure device, having a light source, to expose the portion, which has been charged in the second charging, of the circumferential surface of the photosensitive member;

toner-supply suspension before the portion, which has been exposed in the second exposure, of the photosensitive member passes a position at which developer from the developing unit is configured to initially adhere to the circumferential surface of the photosensitive member, the toner-supply suspension including controlling a developing unit of the image forming apparatus to stop supplying the developer to the photosensitive member; and second-electric-field generation while the photosensitive member rotates at least a full turn, the second electric-field generating including controlling an electric circuit of the image forming apparatus to apply a voltage to generate, in conjunction with an electric field generating member, a second electric field in the corresponding portion of the photosensitive layer when the portion, which has been charged in the second charging and subsequently exposed in the second exposure, of the circumferential surface of the photosensitive member reaches a position facing the electric field generating member, wherein the second electric field is directed in a direction opposite to the first electric field.

17. A non-transitory computer-readable storage medium storing computer- readable instructions, the computer-readable instructions executable by a processor of an image forming apparatus configured to perform a printing process on a recording medium, the printing process including a first charging, a first exposure, and a toner supplying in which toner is supplied from a developing unit to a photosensitive member of the image forming apparatus, the photosensitive member having a photosensitive layer, wherein the computer-readable instructions, when executed by the processor, cause the image forming apparatus to perform:

second charging while the photosensitive member rotates at least a full turn, the second charging including controlling a charger of the image forming apparatus to charge a portion of a circumferential surface of a photosensitive member of the image forming apparatus in a period different from an execution period of the first charging, wherein the charger is configured to charge the circumferential surface of the photosensitive member to generate a first electric field in a corresponding portion of the photosensitive layer;

second exposure while the photosensitive member rotates at least a full turn, the second exposure including controlling an exposure device, having a light source, to expose the portion, which has been charged in the second charging, of the circumferential surface of the photosensitive member;

toner-supply suspension before the portion, which has been exposed in the second exposure, of the photosensitive member passes a position at which developer from the developing unit is configured to initially adhere to the circumferential surface of the photosensitive member, the toner-supply suspension including controlling a developing unit of the image forming apparatus to stop supplying the developer to the photosensitive member; and second-electric-field generation while the photosensitive member rotates at least a full turn, the second electric-field generating including controlling an electric circuit of the image forming apparatus to apply a voltage to generate, in conjunction with an electric field generating member, a second electric field in the corresponding portion of the photosensitive layer when the portion, which has been charged in the second charging and subsequently exposed in the second exposure, of the circumferential surface of the photosensitive member reaches a position facing the electric field generating member, wherein the second electric field is directed in a direction opposite to the first electric field.

* * * * *